US006637874B2

(12) United States Patent
Yazawa et al.

(10) Patent No.: US 6,637,874 B2
(45) Date of Patent: Oct. 28, 2003

(54) LIQUID EJECTING HEAD, SUCTION RECOVERING METHOD, HEAD CARTRIDGE AND IMAGE FORMING APPARATUS

(75) Inventors: Takeshi Yazawa, Kanagawa (JP); Naoji Otsuka, Kanagawa (JP); Hitoshi Sugimoto, Kanagawa (JP); Kiichiro Takahashi, Kanagawa (JP); Hitoshi Nishikori, Tokyo (JP); Osamu Iwasaki, Tokyo (JP); Minoru Teshigawara, Kanagawa (JP); Toshiyuki Chikuma, Kanagawa (JP); Satoshi Seki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/058,750

(22) Filed: Jan. 30, 2002

(65) Prior Publication Data

US 2002/0113845 A1 Aug. 22, 2002

(30) Foreign Application Priority Data

Jan. 31, 2001 (JP) ..... 2001/024549
Jan. 10, 2002 (JP) ..... 2002/003917

(51) Int. Cl.[7] ..... B41J 2/175
(52) U.S. Cl. ..... 347/86
(58) Field of Search ..... 347/86, 84, 12, 347/41.43, 40, 42, 47, 57, 14, 19, 23, 29, 30

(56) References Cited

U.S. PATENT DOCUMENTS

| | | | | |
|---|---|---|---|---|
| 4,313,124 | A | 1/1982 | Hara | 346/140 |
| 4,345,262 | A | 8/1982 | Shirato et al. | 347/10 |
| 4,459,600 | A | 7/1984 | Sato et al. | 347/47 |
| 4,463,359 | A | 7/1984 | Ayata et al. | 347/56 |
| 4,558,333 | A | 12/1985 | Sugitani et al. | 347/65 |
| 4,608,577 | A | 8/1986 | Hori | 347/66 |
| 4,723,129 | A | 2/1988 | Endo et al. | 347/56 |
| 4,740,796 | A | 4/1988 | Endo et al. | 347/56 |
| 5,521,622 | A | 5/1996 | Hock et al. | 347/43 |
| 5,565,899 | A | 10/1996 | Sugimoto et al. | 347/30 |

FOREIGN PATENT DOCUMENTS

| | | |
|---|---|---|
| EP | 0 791 458 | 8/1997 |
| EP | 0 819 541 | 1/1998 |
| JP | 54-056847 | 5/1979 |
| JP | 59-123670 | 7/1984 |
| JP | 59-138461 | 8/1984 |
| JP | 60-71260 | 4/1985 |

*Primary Examiner*—Shih-Wen Hsieh
(74) *Attorney, Agent, or Firm*—Fitzpatrick, Cella, Harper & Scinto

(57) ABSTRACT

A liquid ejection head according to the present invention includes a single liquid supplying port to which a liquid is supplied, a plurality of liquid supplying passages having one end in communication with the liquid supplying port, a plurality of common liquid chambers that are in communication with the other ends of the liquid supplying passages, respectively, and a plurality of ejection port groups which are in communication with the common liquid chambers via liquid channels and from which liquid droplets are ejected. A cross sectional area or length of the liquid supplying passage in communication with the ejection port group having a larger sum of opening areas of the ejection ports is set smaller than that of the liquid supplying passage that is in communication with the ejection port group having a smaller sum of opening areas of the ejection ports.

32 Claims, 15 Drawing Sheets

LIQUID EJECTING HEAD, SUCTION RECOVERING METHOD, HEAD CARTRIDGE AND IMAGE FORMING APPARATUS

This application is based on Patent Application Nos. 2001-024549 filed Jan. 31, 2001 in Japan and 2002-003917 filed Jan. 10, 2002 in Japan, the contents of which are incorporated hereinto by reference.

BACKGROUND OF THE INVENTION

1. Field of the Invention

The present invention relates to a liquid ejection head, a suction recovering method, a head cartridge incorporating the liquid ejection head and an image forming apparatus using the liquid ejection head.

In this Specification, a word "print" refers to not only forming a significant information, such as characters and figures, but also forming images, designs or patterns on a printing medium and processing such as etching and so forth in the printing medium, whether the information is significant or insignificant or whether it is visible so as to be perceived by humans.

The term "printing medium" includes not only paper used in common printing apparatus, but also sheet materials such as cloths, plastic films, metal sheets, glass plates, ceramic sheets, wood panels and leathers or three-dimensional materials such as spheres, round pipes and so forth which can receive the ink.

Further, the word "ink" should be interpreted in its wide sense as with the word "print", refers to liquid that is applied to the printing medium for forming images, designs or patterns, processing such as etching in the printing medium or processing such as coagulating or insolubilizing a colorant in the ink and includes any liquids used for printing.

2. Description of the Related Art

Ink jet printers may inappropriately eject a liquid, that is, ink and/or a treatment liquid that adjusts the printability of the ink on a printing medium, when the entire apparatus may not be used over a long period or the liquid is rarely ejected from particular ones of many ejection ports compared to the others. This is because the liquid evaporates in the ejection ports or liquid channels that are in communication therewith, thereby increasing the viscosity of the ink. Ejected droplets of the liquid or water or dusts may be accreted to an ejection surface of an ink jet head having the ejection ports disposed therein, and newly ejected liquid droplets may pulled by these depositions and thus ejected in a biased direction.

To prevent these inconveniences, conventional ink jet printers comprise the following means as what is called an ejection recovering device, e.g. preliminary ejecting means for ejecting the liquid to liquid receiving element before a print operation to remove viscosity-increased ink, liquid sucking means for sucking the liquid from the ejection ports or a common liquid chamber to remove the depositions, and capping means for preventing the liquid from evaporating through the ejection ports.

Ink jet printers which can print colored images have been developed which comprise one ink jet head having a group of ejection ports for black color as well as ejection port groups for color inks, for example, yellow, magenta, and cyan inks, an independent ink tank and an independent ink supply system provided for each group of ejection ports, and a common recovering cap and a common ejection recovering means shared by all the ejection port groups. Ink jet printers of this kind form color print images other than black ones using two or three colors. In this case, if the amount of color ink ejected per dot is equal to that of black ink ejected per dot, ink dots printed on the printing medium such as paper have an excessively large diameter. Thus, the ejection ports for the color inks have a smaller diameter than those for the black ink or the liquid channels that are in communication with the ejection ports for the color inks have a cross sectional area different from that of the liquid channels which are in communication with the ejection ports for the black ink. With what is called a bubble jet method of ejecting liquid droplets on the basis of heating by electrothermal transducers or the like, the electrothermal transducers for the color inks have a smaller area or the distance between the electrothermal transducers and ejection ports for the color inks is different from that for the black ink. With ink jet printers using plural types of inks having different shading, the same ink jet head or head cartridge has a plurality of ejection port groups formed therein, and the ejection ports of each ejection port group and the liquid channels that are in communication with the ejection ports have different diameters and cross sectional areas, respectively.

To improve the quality of print images and printing speed, ink jet heads have been designed which use the above described ink jet head technique for multicolor inks or inks with different colorant concentrations to eject common ink from a plurality of ejection port groups having different opening areas.

It is assumed that a suction recovering process is performed on a liquid ejection head comprising a liquid supplying port to which a liquid is supplied, liquid supplying passages having one end in communication with the liquid supplying port, a common liquid chamber that is in communication with the other end of each of the liquid supplying passages, and ejection port groups from which liquid droplets are ejected. In this case, when the liquid is simultaneously sucked through a ejection port group having a larger sum of opening areas of the ejection ports and from a ejection port group having a smaller sum of opening areas of the ejection ports, a larger amount of liquid tends to be sucked in the former case.

If the individual liquid channels that are in communication with the ejection port groups have substantially the same volume, substantially the same amount of liquid is discharged during suction recovery. Thus, when the suction recovering process is performed in favor of the ejection port group having a smaller sum of opening areas of the ejection ports, more than a required amount of liquid is sucked and ejected from the ejection port group having a larger sum of opening areas of the ejection ports. As a result, the liquid is wastefully consumed.

With ink jet heads using liquid tanks incorporating porous members such as sponge which holds the liquid, if different amounts of liquid are sucked and ejected from the respective tanks, then bubbles may be contained in the liquid supplying passages in an ink jet head having liquid tanks connected thereto and from which larger amounts of liquid are discharged.

SUMMARY OF THE INVENTION

It is an object of the present invention to provide a liquid ejection head wherein when a liquid is simultaneously sucked through a plurality of ejection port groups having different passage resistances, substantially the same amount of liquid is sucked through the individual ejection port groups or the amounts of liquid sucked through the individual ejection port groups are adjusted to be the same.

It is another object of the present invention to provide a liquid ejection head wherein when a liquid is simultaneously sucked through a plurality of ejection port groups having different ejection port configurations, the liquid can be efficiently sucked, and bubble are prevented from being taken in liquid channels, while restraining the liquid from being wastefully consumed.

It is yet another object of the present invention is to provide a suction recovering method wherein when a liquid is simultaneously sucked through a plurality of ejection port groups having different ejection port configurations, the liquid can be efficiently sucked, and bubble are prevented from being taken in liquid channels, while restraining the liquid from being wastefully consumed, as well as a head cartridge and an image forming apparatus both incorporating a liquid ejection head that can implement such a suction recovering method.

A first aspect of the present invention is in a liquid ejection head comprising a liquid supplying passage having one end in communication with a liquid supplying port to which a liquid is supplied, the liquid supplying passage branching into a plurality of branching paths by the way, a plurality of common liquid chambers which are in communication with the respective ones of the plurality of branching paths, and a plurality of opening groups which are in communication with the respective common liquid chambers via liquid channels and which are opened to the atmosphere, wherein a cross sectional area of the branching path which is in communication with one of the plurality of opening groups which has a larger sum of opening areas is smaller than a cross sectional area of the branching path which is in communication with the opening group which has a smaller sum of opening areas.

A second aspect of the present invention is in a liquid ejection head comprising a liquid supplying passage having one end in communication with a liquid supplying port to which a liquid is supplied, the liquid supplying passage branching into a plurality of branching paths by the way, a plurality of common liquid chambers which are in communication with the respective ones of the plurality of branching paths, and a plurality of opening groups which are in communication with the respective common liquid chambers via liquid channels and which are opened to the atmosphere, wherein a length of the branching path which is in communication with one of the plurality of opening groups which has a larger sum of opening areas is longer than a length of the branching path which is in communication with the opening group which has a smaller sum of opening areas.

A third aspect of the present invention is in a liquid ejection head comprising a liquid supplying passage having one end in communication with a liquid supplying port to which a liquid is supplied, the liquid supplying passage branching into a plurality of branching paths by the way, a plurality of common liquid chambers which are in communication with the respective ones of the plurality of branching paths, and a plurality of opening groups which are in communication with the respective common liquid chambers via liquid channels and which are opened to the atmosphere, wherein a branching portion of the branching path which is in communication with one of the plurality of opening groups which has a larger sum of opening areas is more downstream in a liquid flowing direction than a branching portion of the branching path which is in communication with the opening group which has a smaller sum of opening areas.

In the liquid ejection head according to the third aspect of the present invention, three or more opening groups may be provided.

According to the liquid ejection heads according to the first to third aspects of the present invention, the cross sectional area of the branching path which is in communication with one of the plurality of opening groups which has a larger sum of opening areas is smaller than the cross sectional area of the branching path which is in communication with the opening group which has a smaller sum of opening areas, or a length of the branching path which is in communication with one of the plurality of opening groups which has a larger sum of opening areas is longer than a length of the branching path which is in communication with the opening group which has a smaller sum of opening areas, or in particular three or more ejection port groups are provided, the branching portion of the branching path which is in communication with one of the plurality of opening groups which has a larger sum of opening areas is more downstream in a liquid flowing direction than a branching portion of the branching path which is in communication with the opening group which has a smaller sum of opening areas. Accordingly, the amount of liquid sucked through the ejection port group having a larger sum of opening areas of the ejection ports can be made substantially equal to the amount of liquid sucked through the ejection port group having a smaller sum of opening areas of the ejection ports, therefore restraining the wasteful discharge of the liquid associated with a suction recovering process.

A fourth aspect of the present invention is in a liquid ejection head comprising a liquid supplying passage having one end in communication with a liquid supplying port to which a liquid is supplied, the liquid supplying passage branching into a plurality of branching paths by the way, a plurality of common liquid chambers which are in communication with the respective ones of the plurality of branching paths, and a plurality of opening groups which are in communication with the respective common liquid chambers via liquid channels and which are opened to the atmosphere, wherein the plurality of opening groups include, an opening group that is composed of a plurality of ejection ports arranged at predetermined intervals to eject the liquid to a printing medium, and liquid discharging ports disposed adjacent to the ejection ports which are located at each end of the plurality of the ejection ports in an arrangement direction thereof, the liquid discharging ports not relating to formation of images on the printing medium, and an opening group which is composed only of the ejection ports.

A fifth aspect of the present invention is in a liquid ejection head comprising a plurality of opening groups which are in communication with the respective ones of a plurality of common liquid chambers via liquid channels and which are opened to the atmosphere, the plurality of opening groups each having a plurality of ejection ports arranged at predetermined intervals to eject the liquid to a printing medium, and liquid discharging ports disposed adjacent to the ejection ports which are located at each end of the plurality of the ejection ports in an arrangement direction thereof, the liquid discharging ports not relating to formation of images on the printing medium, wherein the number of the liquid discharging ports in one of the plurality of opening groups which has a larger sum of opening areas of the ejection ports are fewer than the number of the liquid discharging ports in the opening group which has a smaller sum of opening areas of the ejection ports.

A sixth aspect of the present invention is in a liquid ejection head comprising a plurality of opening groups which are in communication with the respective ones of a plurality of common liquid chambers via liquid channels and which are opened to the atmosphere, the plurality of opening groups each having a plurality of ejection ports arranged at predetermined intervals to eject the liquid to the printing medium and liquid discharging ports disposed adjacent to the ejection ports which are located at each end of the plurality of the ejection ports in an arrangement direction thereof, the liquid discharging ports not relating to formation of images on the printing medium, wherein the sum of opening areas of the liquid discharging ports in one of the plurality of opening groups which has a larger sum of opening areas of the ejection ports is smaller than the sum of opening areas of the liquid discharging ports in the opening group which has a smaller sum of opening areas of the ejection ports.

According to the liquid ejection heads according to the fourth to sixth aspects, the plurality of opening groups include an opening group that is composed of a plurality of ejection ports arranged at predetermined intervals to eject the liquid to a printing medium and liquid discharging ports disposed adjacent to the ejection ports which are located at each end of the plurality of the ejection ports in an arrangement direction thereof, the liquid discharging ports not relating to formation of images on the printing medium, and an opening group that is composed only of the ejection ports, or the number of the liquid discharging ports in one of the plurality of opening groups which has a larger sum of opening areas of the ejection ports are fewer than the number of the liquid discharging ports in the opening group which has a smaller sum of opening areas of the ejection ports, or the sum of opening areas of the liquid discharging ports in one of the plurality of opening groups which has a larger sum of opening areas of the ejection ports is smaller than the sum of opening areas of the liquid discharging ports in the opening group which has a smaller sum of opening areas of the ejection ports. Accordingly, the amount of liquid sucked through the ejection port group having a larger sum of opening areas of the ejection ports can be made substantially equal to the amount of liquid sucked through the ejection port group having a smaller sum of opening areas of the ejection ports, therefore the suction recovering process for the liquid ejection head can be effectively performed.

In the liquid ejection heads according to the first to sixth aspects of the present invention, at least one of the plurality of opening groups has a different number of openings from those of the other opening groups. Alternatively, at least one of the plurality of opening groups has at least one opening, the area of which is different from those of the openings of the other opening groups.

When at least one of the plurality of opening groups has a different number of openings from those of the other opening groups, particular liquid droplets can be printed at a higher speed than the other liquid droplets. For example, when the opening group for black ink has more openings than the opening groups for cyan, magenta, and yellow inks, the production costs of a print head can be reduced, and the monochromatic printing speed can be increased.

When at least one of the plurality of opening groups has at least one opening, the area of which is different from those of the openings of the other opening groups, then by forming smaller- and larger-droplet ejection ports for each of the ejection port groups for the cyan and magenta inks, while forming only larger-droplet ejection ports for the ejection port group for the yellow ink, which involves unnoticeable ink droplets, the production costs of the print head can be reduced, and different amounts of ink droplets can be ejected from each of the ejection port groups for the cyan and magenta inks. Thus, the printing speed and image quality can be improved by appropriately selecting ejected dots, for example, ejecting larger ink droplets for high-duty images with unnoticeable dots, while ejecting smaller ink droplets for low-duty images with noticeable dots.

In the liquid ejection heads according to the fifth and sixth aspects of the present invention, the plurality of common liquid chambers may be in communication with the respective ones of a plurality of branching paths of a liquid supplying passage having one end in communication with the liquid supplying port to which the liquid is supplied, the liquid supplying passage branching into the plurality of branching paths by the way.

The seventh aspect of the present invention is in a liquid ejection head comprising a plurality of head portions each having a liquid supplying passage having one end in communication with a liquid supplying port to which a liquid is supplied, the liquid supplying passage branching into a plurality of branching paths by the way, a plurality of common liquid chambers which are in communication with the respective ones of the plurality of branching paths, and a plurality of opening groups which are in communication with the respective common liquid chambers via liquid channels and which are opened to the atmosphere, at least one of all the opening groups having a different number of openings from those of the other opening groups, wherein the sum of the opening areas in one of all the opening groups which has the largest sum is 1.6 or less times the sum of the opening areas in the other opening group which has the smallest sum, and wherein the sum of the areas of the openings constituting the plurality of opening groups in one of the plurality of head portions which has the largest sum is 5 or less times the sum of the areas of the openings constituting the plurality of opening groups in the other head portion which has the smallest sum.

The eighth aspect of the present invention is in a liquid ejection head comprising;

a first head portion having a liquid supplying passage having one end in communication with a liquid supplying port to which a liquid is supplied, the liquid supplying passage branching into a plurality of branching paths by the way, a plurality of common liquid chambers that are in communication with the respective ones of the plurality of branching paths, and a plurality of opening groups which are in communication with the respective common liquid chambers via liquid channels and which are opened to the atmosphere, and a second head portion having common liquid chambers that are in communication with a liquid supplying port to which a liquid is supplied, and opening groups which are in communication with the respective common liquid chambers via liquid channels and which are opened to the atmosphere, at least one of all the opening groups having a different number of openings from those of the other opening groups, wherein the sum of the opening areas in one of all the opening groups which has the largest sum is 1.6 or less times the sum of the opening areas in the other opening group which has the smallest sum, and wherein the sum of the areas of the openings constituting the plurality of opening groups in one of the first and second head portions which has the largest sum is 5 or less times the sum of the areas of the openings constituting the plurality of opening groups in the other head portion which has the smallest sum.

The ninth aspect of the present invention is in a liquid ejection head comprising a plurality of head portions each having a liquid supplying passage having one end in communication with a liquid supplying port to which a liquid is supplied, the liquid supplying passage branching into a plurality of branching paths by the way, a plurality of common liquid chambers which are in communication with the respective ones of the plurality of branching paths, and a plurality of opening groups which are in communication with the respective common liquid chambers via liquid channels and which are opened to the atmosphere, at least one of all the opening groups having at least one opening, the area of which is different from those of the openings of the other opening groups, wherein the sum of the opening areas in one of all the opening groups which has the largest sum is 1.6 or less times the sum of the opening areas in the opening group which has the smallest sum, and wherein the sum of the areas of the openings constituting the plurality of opening groups in one of the plurality of head portions which has the largest sum is 5 or less times the sum of the areas of the openings constituting the plurality of opening groups in the other head portion which has the smallest sum.

The tenth aspect of the present invention is in a liquid ejection head comprising;

a first head portion having a liquid supplying passage having one end in communication with a liquid supplying port to which a liquid is supplied, the liquid supplying passage branching into a plurality of branching paths by the way, a plurality of common liquid chambers that are in communication with the respective ones of the plurality of branching paths, and a plurality of opening groups which are in communication with the respective common liquid chambers via liquid channels and which are opened to the atmosphere, and a second head portion having common liquid chambers which are in communication with a liquid supplying port to which a liquid is supplied, and opening groups which are in communication with the respective common liquid chambers via liquid channels and which are opened to the atmosphere, at least one of all the opening groups having at least one opening, the area of which is different from those of the openings of the other opening groups, wherein the sum of the opening areas in one of all the opening groups which has the largest sum is 1.6 or less times the sum of the opening areas in the other opening group which has the smallest sum, and wherein the sum of the areas of the openings constituting the plurality of opening groups in one of the first and second head portions which has the largest sum is 5 or less times the sum of the areas of the openings constituting the plurality of opening groups in the other head portion which has the smallest sum.

According to the liquid ejection heads according to the seventh to tenth aspects of the present invention, the sum of the opening areas in one of all the opening groups which has the largest sum is 1.6 or less times the sum of the opening areas in the other one of all the opening groups which has the smallest sum, and the sum of the areas of the openings constituting the plurality of opening groups in one of the first and second head portions which has the largest sum is 5 or less times the sum of the areas of the openings constituting the plurality of opening groups in the other head portion which has the smallest sum. Accordingly, the amount of liquid sucked from the head section having the largest sum of opening areas of the ejection ports can be made substantially equal to the amount of liquid sucked from the head section having the smallest sum of opening areas of the ejection ports, therefore restraining the wasteful discharge of the liquid associated with a suction recovering process.

In the liquid ejection heads according to the first to third and seventh to tenth aspects of the present invention, the opening group may have a plurality of ejection ports arranged at predetermined intervals to eject the liquid to a printing medium, and liquid discharging ports not relating to formation of images on the printing medium and disposed adjacent to those of the ejection ports which are located at each end of the plurality of ejection ports in an arrangement direction thereof. In this case, bubbles that may be collected at the opposite ends of the common liquid chamber can be effectively removed through the liquid discharging port during suction recovery.

In the liquid ejection heads according to the first to tenth aspects of the present invention, the opening groups may be covered by a common capping member before a sucking operation is performed. In this case, the suction recovering process for the liquid ejection head can be effectively performed.

In the liquid tank in which the liquid is stored and which have the porous members for retaining the liquid, when a large amount of liquid is sucked during suction recovery, air passages may be formed in the porous members to draw bubbles into the liquid channels of the liquid ejection head, thereby degrading images. However, the liquid ejection head of the present invention can achieve a good suction recovering process.

Each of the liquid channels may be provided with an ejection energy generating portion that causes liquid droplets to be ejected from the openings. In this case, the ejection energy generating portion may have an electrothermal transducer that generates thermal energy required to cause film boiling in the liquid.

In the liquid ejection heads according to the seventh to tenth aspects of the present invention, the sum of the opening areas in the opening group having the largest sum may be substantially equal to the sum of the opening areas in the opening group having the smallest sum. In this case, the amounts of liquid sucked through these opening groups can be made substantially equal.

In the liquid ejection heads according to the ninth and tenth aspects of the present invention, at least one of all the opening groups may have a different number of openings from those of the other opening groups. In this case, particular liquid droplets can be printed at a higher speed than the other liquid droplets. For example, when the opening group for black ink has more openings than the opening groups for cyan, magenta, and yellow inks, the production costs of a print head can be reduced, and the monochromatic printing speed can be increased.

The eleventh aspect of the present invention is in a suction recovering method of simultaneously sucking a liquid through all opening groups of a liquid ejection head according to any one of the first to tenth aspects of the present invention to allow liquid droplets to be appropriately ejected from the opening groups, the amounts of liquid sucked through the opening groups are substantially equal. According to the present invention, in simultaneously sucking the liquid through the plurality of ejection port groups of the liquid ejection head to allow liquid droplets to be always appropriately ejected from the plurality of ejection port groups, the amounts of liquid sucked through the ejection port groups are made substantially equal. This restrains the wasteful discharge of the liquid associated with a suction recovering process, therefore achieving an efficient suction recovering process.

A twelfth aspect of the present invention is in a head cartridge comprising a liquid ejection head according to any one of the first to tenth aspects of the invention, and a liquid tank storing a liquid supplied to the liquid ejection head via a liquid supplying port provided to the liquid ejection head.

In the head cartridge according to the twelfth aspect of the present invention, the liquid tank may be detachably attached to the liquid ejection head.

A thirteenth aspect of the present invention is in an image forming apparatus for forming an image on a print medium by using a liquid ejected from a plurality of ejection port groups of a liquid ejection head according to any one of the first to tenth aspects of the present invention or from a plurality of ejection port groups of a liquid ejection head of a head cartridge according to the twelfth aspect of the present invention, the apparatus comprising a mounting portion for mounting the liquid ejection head or the head cartridge, means for feeding the printing medium, a capping member that can cover a ejection port surface in which the plurality of ejection port groups of the liquid ejection head are opened, and suction recovering means for sucking a liquid present in the liquid ejection head, through the plurality of ejection port groups via the capping member.

In the image forming apparatus according to the thirteenth aspect of the present invention, the mounting portion may have a carriage for scanning in a direction crossing a direction in which the printing medium are fed. In this case, the liquid ejection head may be mounted so as to be detachably attached to the carriage via detaching means.

The liquid may be ink and/or a treatment liquid that adjusts printability of the ink on the printing medium.

The above and other objects, effects, features and advantages of the present invention will become more apparent from the following description of embodiments thereof taken in conjunction with the accompanying drawings.

DETAILED DESCRIPTION OF PREFERRED EMBODIMENTS

An embodiment in which an image forming apparatus according to the present invention has been applied to a serial scan type ink jet printer will be described in detail with reference to FIGS. 1 to 15. However, the present invention is not limited to this embodiment, but this embodiment may be combined with others or the present invention is also applicable to other techniques to be included in the concept of the present invention described in the claims.

Figure 1:
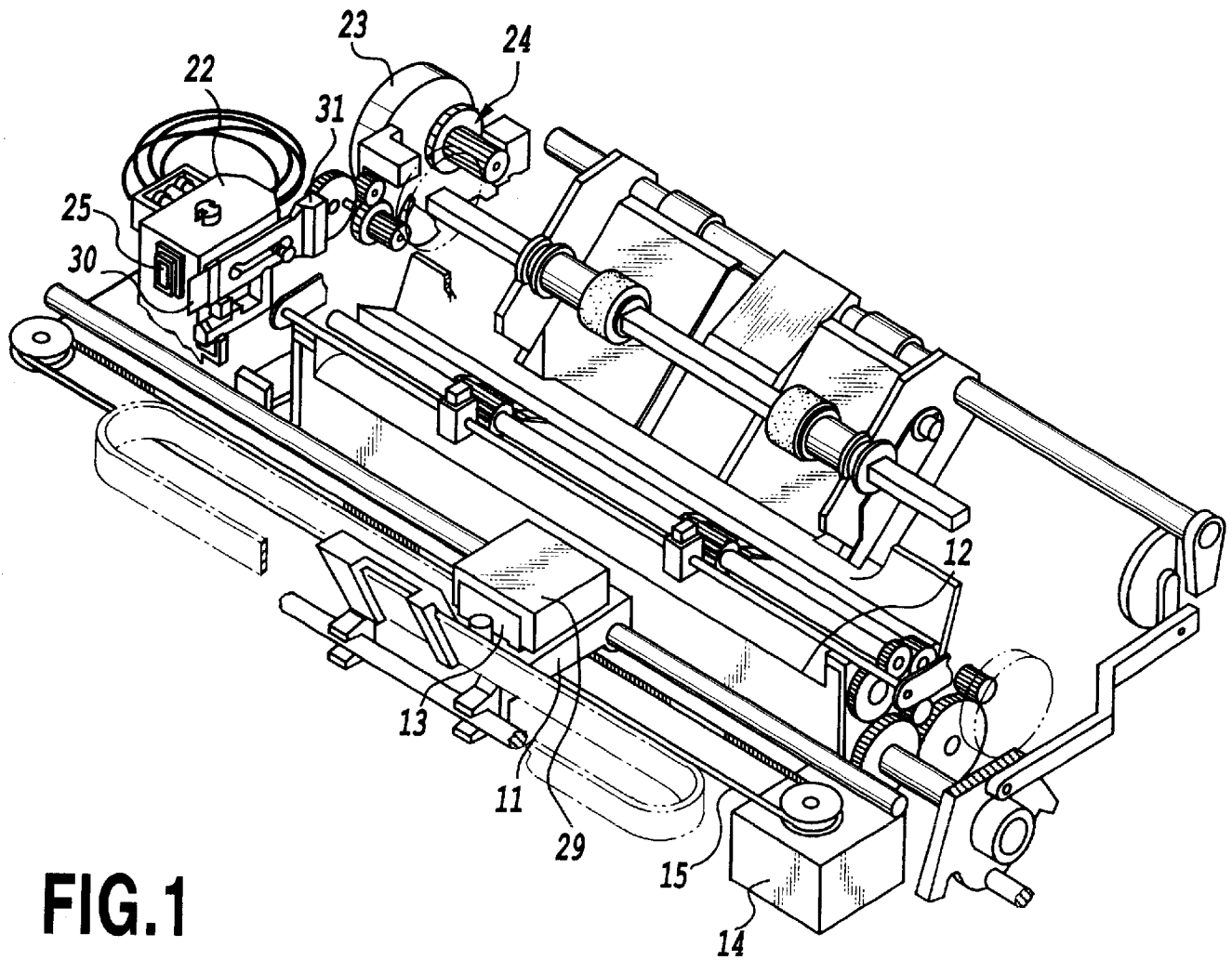
FIG. 1 is a perspective view schematically illustrating the structure of an embodiment in which an image forming apparatus according to the present invention is applied to an ink jet printer.

FIG. 1 schematically shows the structure of an ink jet printer according to this embodiment. A carriage 11 removably holds a head cartridge 13 via detaching means (not shown). The head cartridge 13, in which a liquid tank (not shown) is detachably attached, has a plurality of ejection port groups 19A and 19B (see FIG. 3) formed therein. The ejection port groups 19A and 19B are located opposite a print surface of a printing medium such as a printing paper (not shown) fed on a platen 12, and eject ink and/or a treatment liquid that adjusts the printability of the ink on the printing medium. The carriage 11 is connected to one end of a drive belt 15 that transmits the driving force of a head driving motor 14, and enables the head cartridge 13 to reciprocate and scan over the full width of the printing medium.

Figure 2:
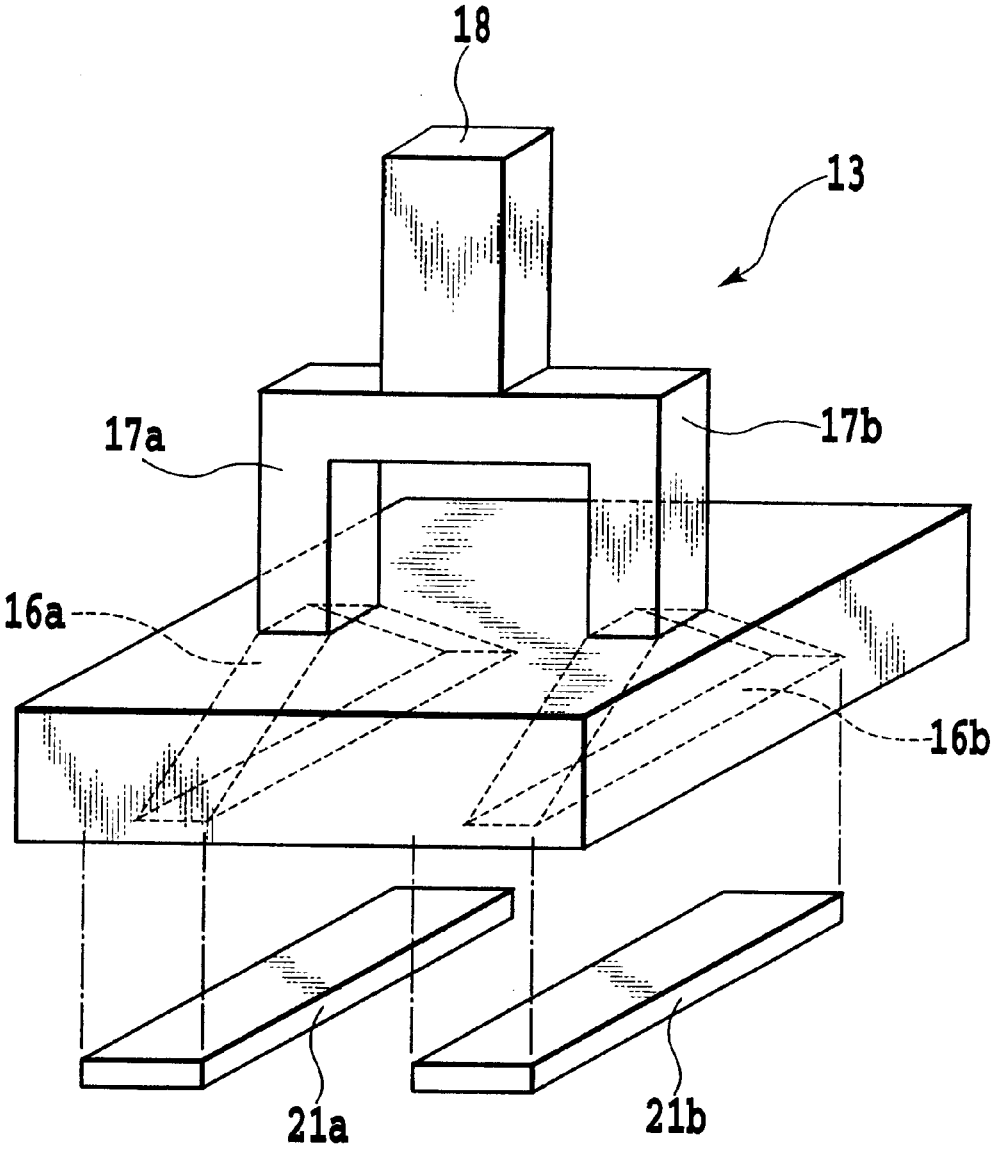
FIG. 2 is an exploded perspective view schematically illustrating the structure of an embodiment of a print head used in the ink jet printer shown in FIG. 1.
Figure 3:
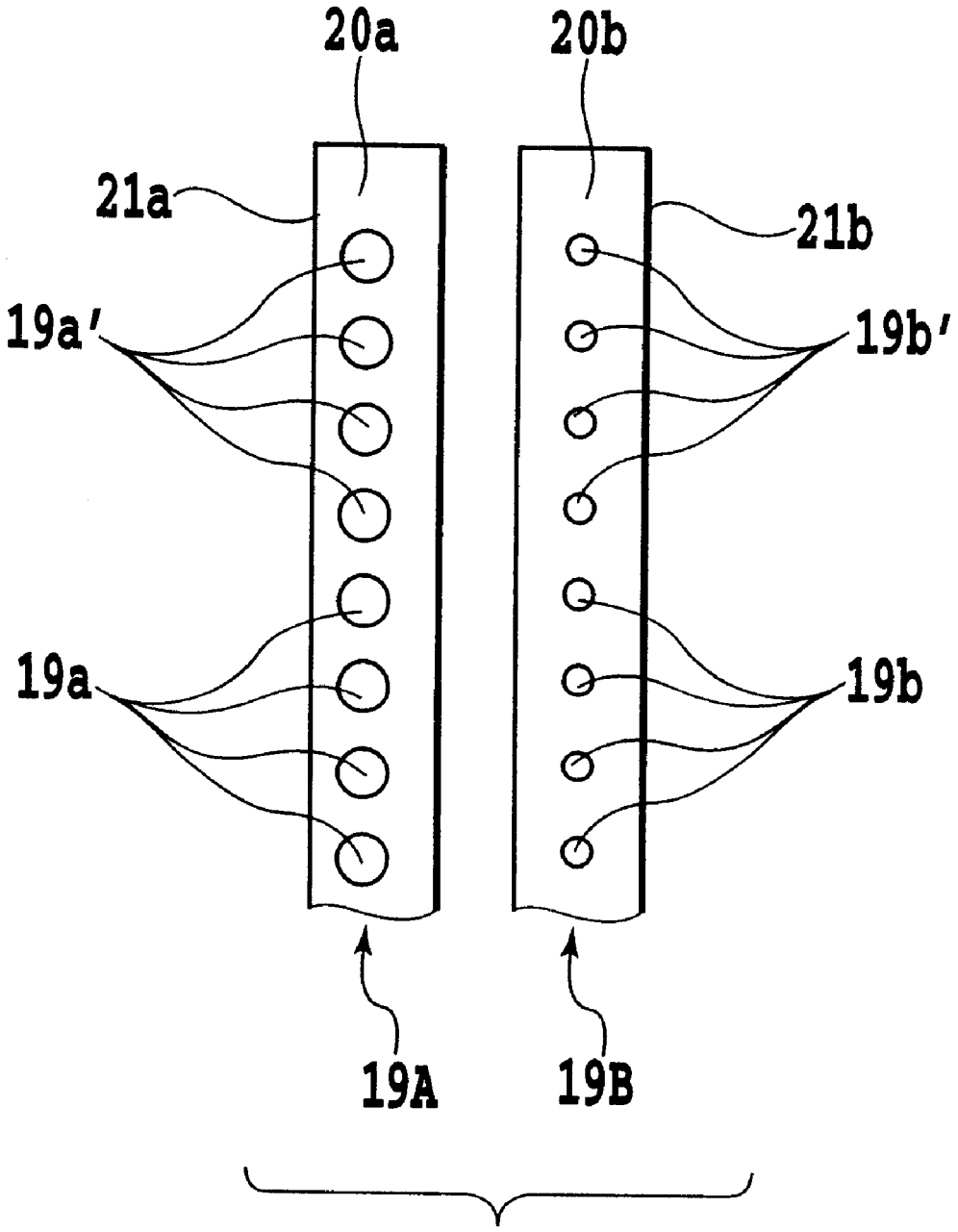
FIG. 3 is a schematic view illustrating how groups of ejection ports in a print head, shown in FIG. 2, are arranged.

FIG. 2 schematically shows the structure of an essential part of the head cartridge 13 of this embodiment as disassembled, and FIG. 3 shows the front shape of a ejection port plate thereof. The head cartridge 13 of this embodiment includes a plurality of (in the illustrated example, two) common liquid chambers 16*a* and 16*b* in communication with a plurality of (in the illustrated example, two) liquid supplying pipes 17*a* and 17*b*, respectively, which form liquid supplying passages. The other ends of the liquid supplying pipes 17*a* and 17*b* are connected together so as to be in communication with a liquid supplying port 18 to which a liquid is supplied. The common liquid chambers 16*a* and 16*b* have a plurality of (in the illustrated example, two) ejection port plates 21*a* and 21*b*, respectively, provided to the other ends thereof. The ejection port plates 21*a* and 21*b* have a large number of liquid channels (not shown) formed therein and the ejection port groups 19A and 19B opened therein and which are in communication with the liquid channels. The liquid supplied through the liquid supplying port 18 passes through the liquid supplying pipes 17*a* and 17*b*, enters the common liquid chambers 16*a* and 16*b*, and are ejected through the individual ejection ports 19*a* and 19*b* via the liquid channels as liquid droplets. In the ejection port plate 21*a* from which larger liquid droplets are ejected, the individual ejection ports 19*a* constituting the ejection port group 19A have a larger diameter, and the liquid channels that are in communication with the ejection ports have a larger volume. In the ejection port plate 21*b* from which smaller liquid droplets are ejected, the individual ejection ports 19*b* constituting the ejection port group 19B have a smaller diameter, and the liquid channels that are in communication with the ejection ports have a smaller volume. In this embodiment, these ejection port plates 21*a* and 21*b* each have 128 ejection ports 19*a* and 19*b* arranged at an interval of 600 dpi. These diameters are set at about 16 μm for the ejection ports 19*a* and at about 10 μm for the ejection ports 19*b*. The volume of individual liquid droplets ejected through the ejection ports 19*a* from which larger liquid droplets are ejected is set at about 4 picoliters, and the volume of individual liquid droplets ejected through the ejection ports 19*b* from which smaller liquid droplets are ejected is set at about 2 picoliters.

In this embodiment, a total of 16 ejection ports 19*a*' and 19*b*' corresponding to four ejection ports from each end of the arrangement of the ejection port group 19A or 19B are dummies that do not relate to the formation of images, that is, liquid discharging ports. The liquid discharging ports 19*a*' and 19*b*' function so that when a suction recovering operation is performed, bubbles that are prone to be present at the opposite ends of the arrangement of each ejection port group 19A or 19B are removed through the liquid discharging ports 19*a*' and 19*b*'.

An ejection recovering device 22 for the head cartridge 13 is disposed at one end of the scan travel path of the head cartridge 13, for example, opposite a home position. The ejection recovering device 22 applies a capping member 25 to ejection port surfaces 20*a* and 20*b* of the head cartridge 13 via a mechanical transmission mechanism 24 using the driving force of a recovery motor 23. In connection with the application of the capping member 25 of the ejection recovering device 22 to the head cartridge 13, suction means (not shown) incorporated in the ejection recovering device 22 performs a liquid sucking operation, or pressurizing means (not shown) incorporated in a liquid supplying passage by the way to the head cartridge 13 transmits the liquid under pressure. Thus, the liquid is forced to be discharged from the individual ejection ports 19*a* and 19*b*. That is, an ejection recovering process is performed to remove a liquid such as viscosity-increased ink which is present in the ejection ports 19*a* and 19*b* and the liquid channels that are in communication therewith. Once a print operation has been completed, the capping member 25 covers and closes both the ejection port surfaces 20*a* and 20*b* to protect the ejection port surfaces 20*a* and 20*b* of the head cartridge 13.

Figure 4:
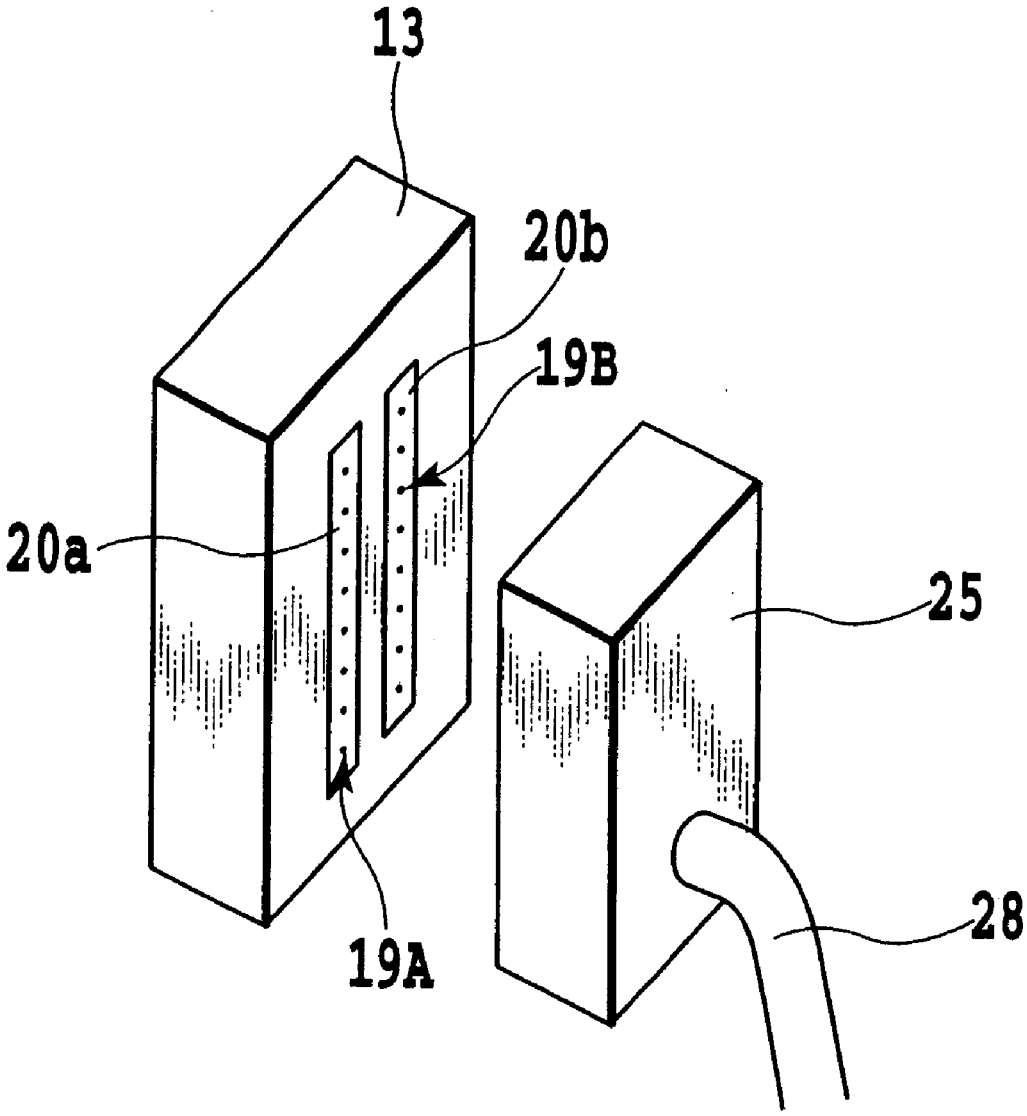
FIG. 4 is a perspective view illustrating the appearance of a capping member used in the ink jet printer shown in FIG. 1, together with the print head.
Figure 5:
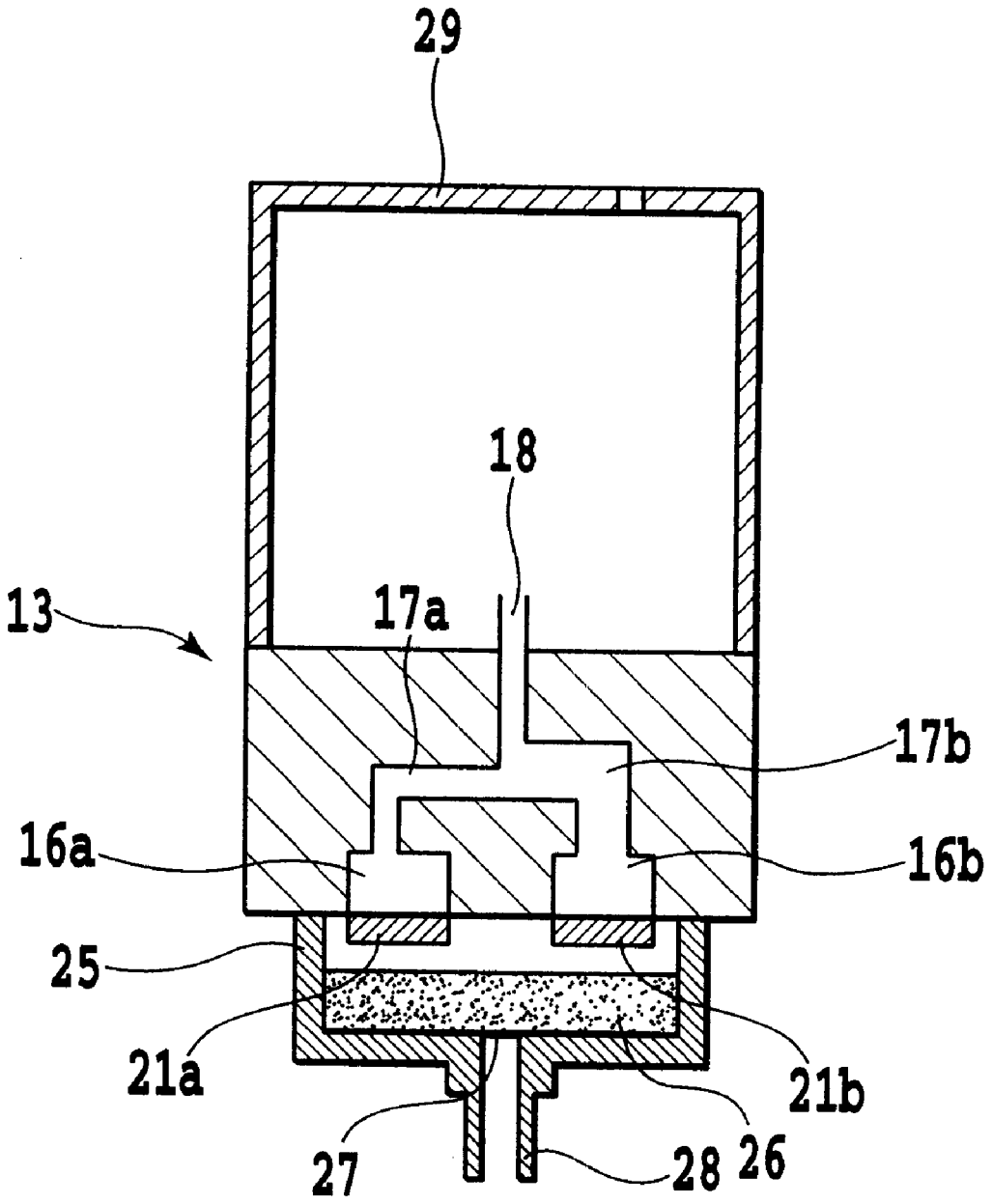
FIG. 5 is a sectional view illustrating how the capping member shown in FIG. 4 performs a capping operation.

FIG. 4 shows the appearance of part of the above described capping member 25, and FIG. 5 shows, in section, how the capping member 25 is applied to the head cartridge 13. The capping member 25 has a porous or fibrous waste ink absorber 26 arranged inside to absorb and retain liquid droplets remaining in the capping member 25. A suction port 27 is opened to face the waste ink absorber 26. The suction port 27 has a suction pipe 28 connected thereto. The capping member 25 abuts against the ejection port surfaces 20*a* and 20*b* of the head cartridge 13 in tight contact therewith. This prevents the liquid from evaporating from the ejection ports 19*a* and 19*b*. When the head cartridge 13 is left unused over a long period, the liquid in the ejection ports 19*a* and 19*b*, liquid channels, and common liquid chambers 16*a* and 16*b* may become more viscous, or bubbles may be mixed in the liquid channels or common liquid chambers 16*a* and 16*b* from the exterior. Also when the liquid tank 29 is replaced, bubbles may enter the above parts through the connecting portion. For removal of a viscosity-increased liquid or bubbles or for other purposes, the capping member 25 is brought into pressure contact with the ejection port surfaces 20*a* and 20*b* of the head cartridge 13. Then, a suction recovery process is performed by using a suction pump (not shown) to suck the viscosity-increased liquid or bubbles from the head cartridge 13.

In this embodiment, the cross sectional area of the passage of the liquid supplying pipe 17*a* that is in communication with the ejection ports 19*a* from which larger liquid droplets are ejected is set at a small value, for example, about half of that of the liquid supplying pipe 17*b* that is in communication with the ejection ports 19*b* from which smaller liquid droplets are ejected. With this configuration, the sum of the areas of the ejection ports 19*a* constituting the ejection port group 19A is so large that the ejection port group 19A from which larger liquid droplets are ejected and from which a relatively large amount of liquid is conventionally discharged during suction recovery can have a relatively large passage resistance. At the same time, the sum of the areas of the ejection ports 19*b* constituting the ejection port group 19B is so small that the ejection port group 19B from which smaller liquid droplets are ejected and from which a relatively small amount of liquid is conventionally discharged during suction recovery can have a relatively small passage resistance. As a result, the amount of liquid discharged from the ejection port group 19A from which larger liquid droplets are ejected can be made closer to the amount of liquid discharged from the ejection port group 19B from which smaller liquid droplets are ejected. It is also impossible to restrain the liquid from being wastefully discharged during suction recovery.

In this embodiment, the passage cross area of the liquid supplying pipe 17*a* that is in communication with the ejection port group 19A from which larger liquid droplets are ejected is uniformly set. However, similar effects are also obtained by partially reducing the cross sectional area of the liquid supplying pipe 17*a*.

A flexible wiping blade 30 formed of ether urethane or the like is disposed at a side of the suction recovering device 22 and is held by a blade holding member 31. The wiping blade 30 is operated by the above described recovery motor 17 and mechanical transmission mechanism 24, as in the case with the ejection recovering device 22, so that its tip portion can come into sliding contact with the ejection port surfaces 20*a* and 20*b* of the head cartridge 13. Thus, liquid mists or dusts that have adhered to the ejection port surface 20*a* or 20*b* of the head cartridge 13 can be wiped off with appropriate timings while the head cartridge 13 is performing a print operation. Alternatively, the wiping blade 30 can be protruded into the travel path of the head cartridge 13 to wipe off liquid mists or dusts that have adhered to the ejection port surface 20*a* or 20*b* of the head cartridge 13 as the head cartridge 13 scans and moves to the home position.

In the above described embodiment, the passages in the two liquid supplying pipes 17*a* and 17*b* have different cross sectional areas. However, similar effects are also obtained when the liquid supplying pipes 17*a* and 17*b* have different passage lengths.

Figure 6:
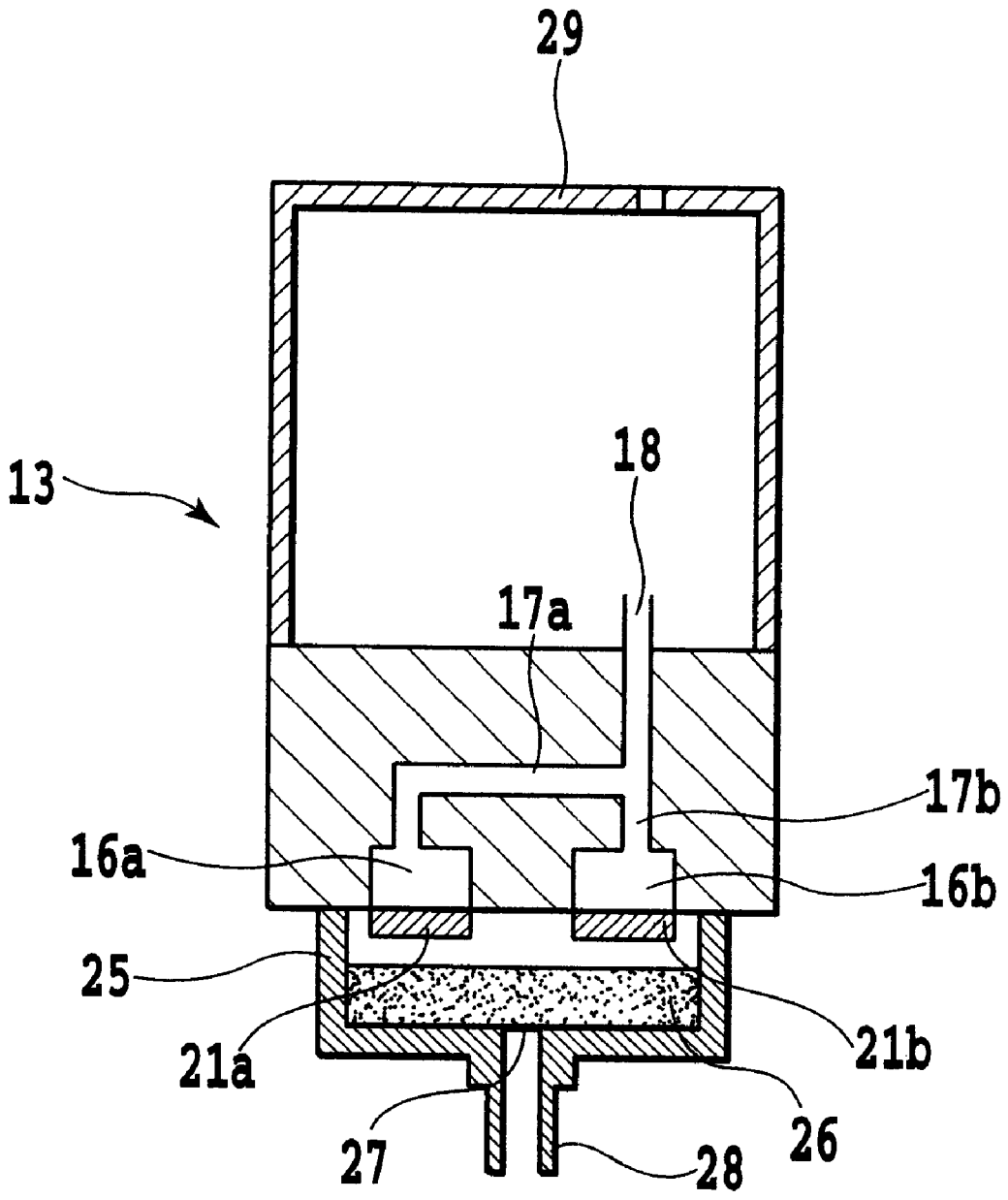
FIG. 6 is a sectional view illustrating another embodiment of a liquid ejection head according to the present invention, together with a capping member therefor.

FIG. 6 shows the sectional structure of another embodiment of the liquid ejection head according to the present invention. Elements having the same functions as those in the above embodiment are denoted by the same reference numerals, and duplicate description will be omitted. In this embodiment, the passage length of the liquid supplying pipe 17*a* that is in communication with the ejection ports 19*a* from which larger liquid droplets are ejected is set, for example, about twice larger than that of the liquid supplying pipe 17*b* that is in communication with the ejection ports 19*b* from which smaller liquid droplets are ejected. With this configuration, the sum of the areas of the ejection ports 19*a* is so large that the ejection port group 19A from which larger liquid droplets are ejected and from which a relatively large amount of liquid is normally discharged during suction recovery can have a relatively large passage resistance. At the same time, the sum of the areas of the ejection ports 19*b* is so small that the ejection port group 19B from which smaller liquid droplets are ejected and from which a relatively small amount of liquid is normally discharged during suction recovery can have a relatively small passage resistance. As a result, the amount of liquid discharged from the ejection port group 19A from which larger liquid droplets are ejected can be made closer to the amount of liquid discharged from the ejection port group 19B from which smaller liquid droplets are ejected. It is also impossible to restrain the liquid from being wastefully discharged during suction recovery.

In the above two embodiments, the numbers of the ejection ports 19*a* and 19*b* constituting the two ejection port groups 19A and 19B, respectively, are the same, so that the passage crosses sections or lengths of the liquid supplying pipes 17*a* and 17*b* must differ from each other. However, similar effects are obtained by disposing, adjacent to the ejection ports 19*b*, a large number of liquid discharging ports that are in communication with the common liquid chamber 16*b* from which smaller liquid droplets are ejected.

Figure 7:
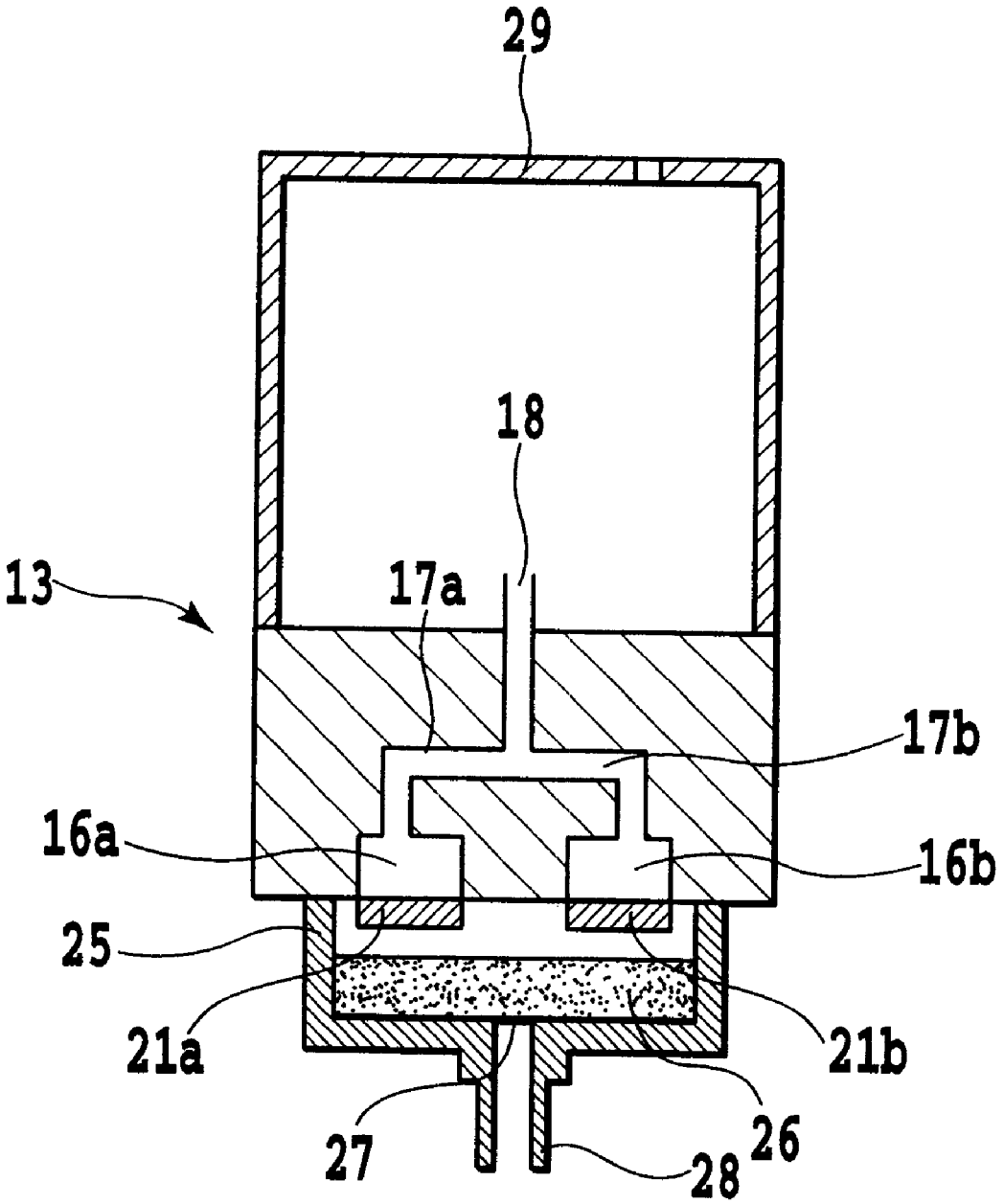
FIG. 7 is a sectional view illustrating yet another embodiment of the liquid ejection head according to the present invention, together with a capping member therefor.
Figure 8:
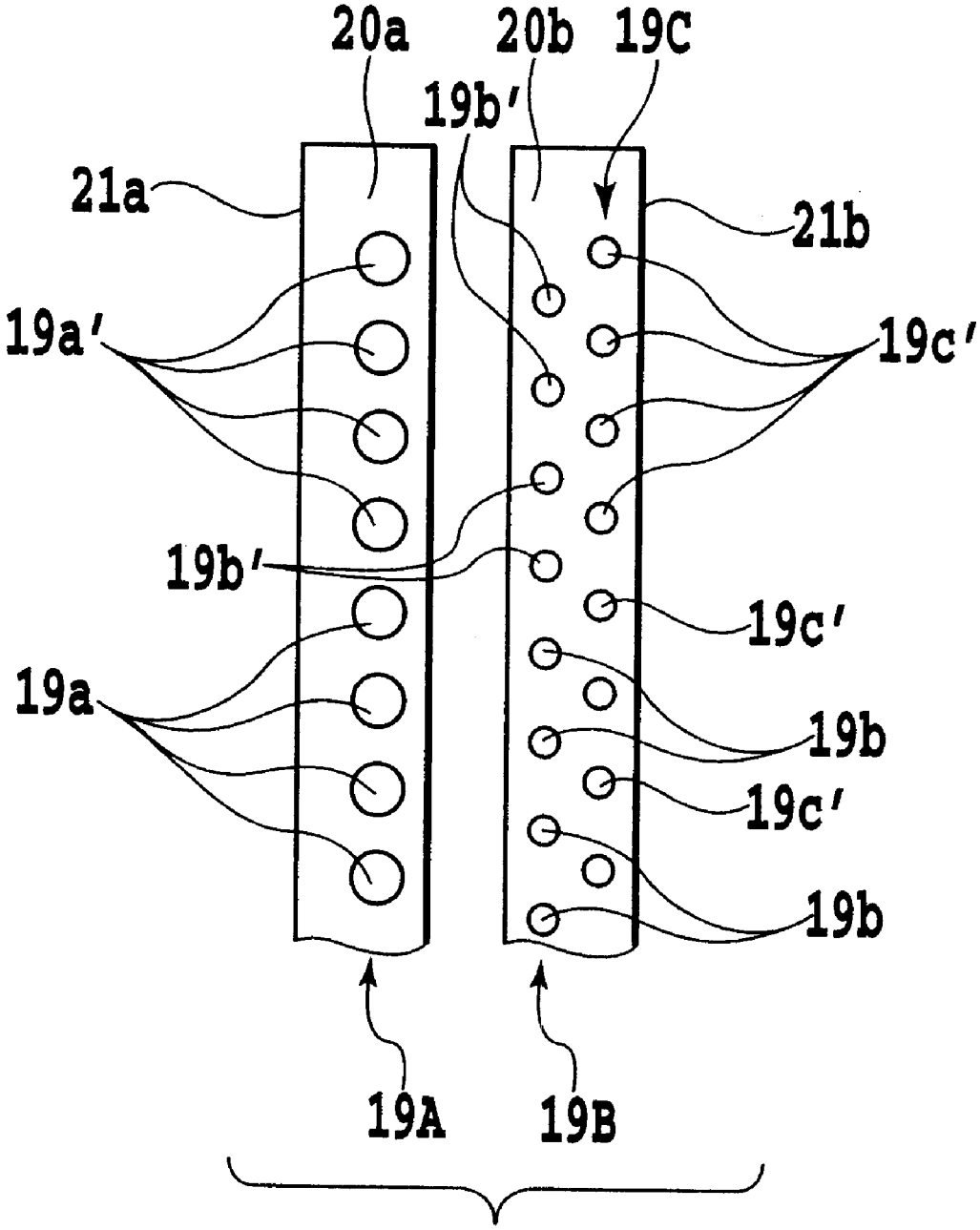
FIG. 8 is a schematic view illustrating how groups of ejection ports in the liquid ejection head according to the embodiment shown in FIG. 7 are arranged.

FIG. 7 shows the sectional structure of another embodiment of the liquid ejection head according to the present invention, and FIG. 8 schematically shows the front shape of the ejection port surface thereof. Elements having the same functions as those in the above embodiment are denoted by the same reference numerals, and duplicate description will be omitted. In this embodiment, the passage length of the liquid supplying pipe 17*a* that is in communication with the ejection port group 19A from which larger liquid droplets are ejected is set the same as that of the liquid supplying pipe 17*b* that is in communication with the ejection port group 19B from which smaller liquid droplets are ejected. The ejection port plate 21*b* having the ejection port group 19B formed therein and from which smaller liquid droplets are ejected has a group of liquid discharging ports 19C formed along the ejection port group 19C and which do not relate to the formation of images. The number, size, and shape of these ports are set substantially the same as those of the ejection ports 19*b*. In this embodiment, a total of 128 ejection ports 19*b* and liquid discharging ports 19*b*' as well as 128 liquid discharging ports 19*c*' are arranged at an interval of 600 dpi and have a set diameter of about 12 $\mu$m. With this configuration, the sum of the areas of the ejection ports 19*b* from which smaller liquid droplets are ejected and the liquid discharging ports 19*b*' can be made substantially equal to the sum of the areas of the ejection ports 19*a* from which larger liquid droplets are ejected and the liquid discharging ports 19*a*'. Thus, the amount of liquid discharged from the ejection port group 19A can be made substantially equal to the amount of liquid discharged from the ejection port group 19B. This enables an efficient suction recovering process to be achieved.

The area, size, and shape of the liquid discharging ports 19*c*' constituting the liquid discharging port group 19C may be other than those described in the above embodiment. Effects obtained more closely meet the objects of the present invention as the sum of the areas of the ejection ports 19*b* from which smaller liquid droplets are ejected and the liquid discharging ports 19*b*' is closer to the sum of the areas of the ejection ports 19*a* from which larger liquid droplets are ejected and the liquid discharging ports 19*a*'. Ejection energy generating portions may be incorporated in the liquid channels that are in communication with the liquid discharging ports 19*c*' constituting the liquid discharging port group 19C so as to eject liquid droplets as required. When the sum of the areas of the ejection ports 19*b* from which smaller liquid droplets are ejected and the liquid discharging ports 19*b*' cannot be made equal to the sum of the areas of the ejection ports 19*a* from which larger liquid droplets are ejected and the liquid discharging ports 19*a*', then the cross sectional areas or lengths of the passage of the liquid supplying pipes 17*a* and 17*b* can be effectively changed as in the embodiments shown in FIGS. 5 and 6.

In the embodiment shown in FIG. 3, the sizes and shapes of the liquid discharging ports 19*a*' and 19*b*' formed in the ejection port plates 21*a* and 21*b*, respectively, are equal to those of the liquid discharging ports 19*a* and 19*b* also formed therein. Alternatively, the objects of the present invention are also achieved to some degree by instead forming smaller liquid discharging ports in the ejection port plate 21*a* having the ejection port group 19A formed therein and from which larger liquid droplets are ejected and forming larger liquid discharging ports in the ejection port plate 21*b* having the ejection port group 19B formed therein and from which larger liquid droplets are ejected.

Figure 9:
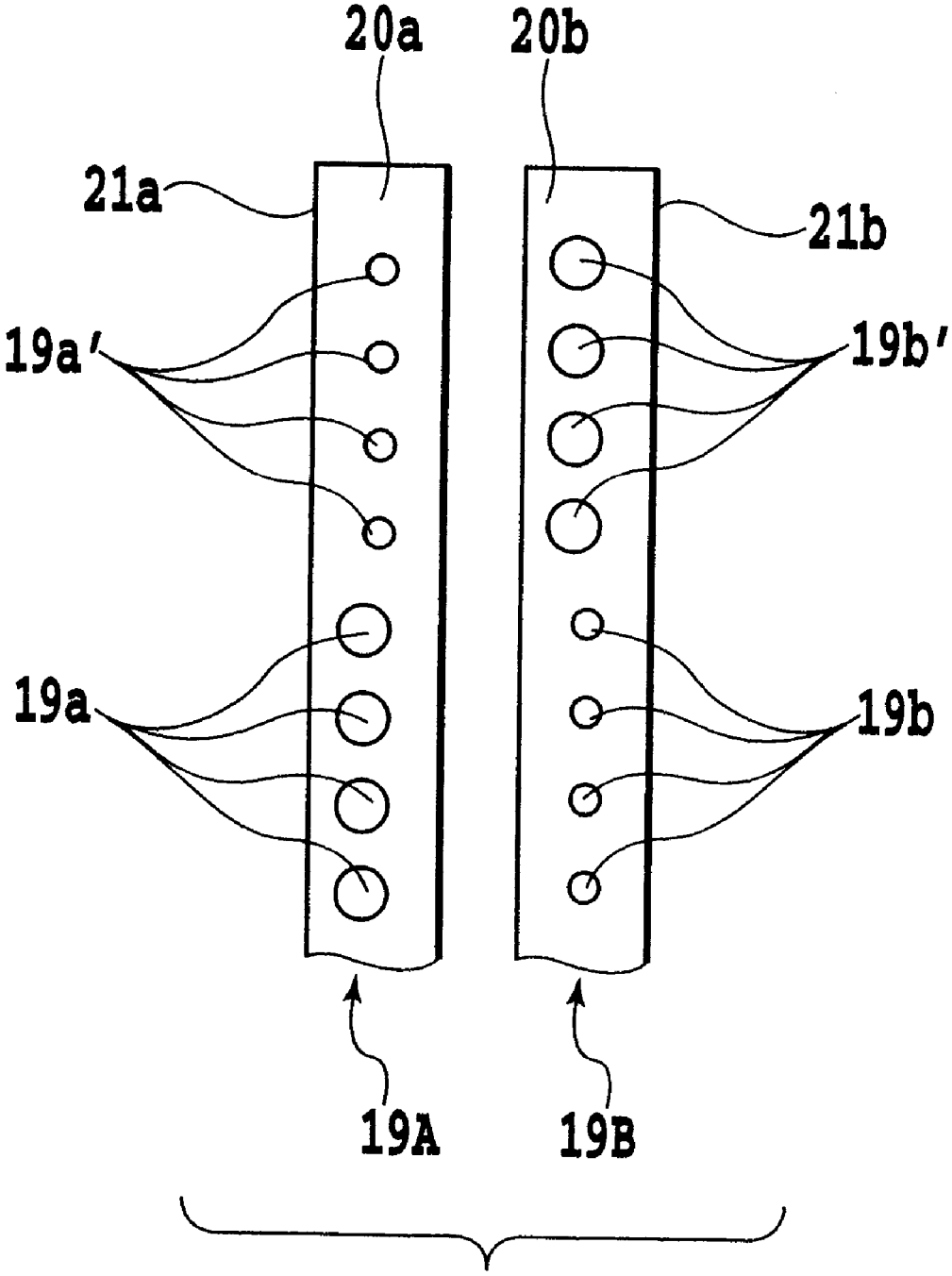
FIG. 9 is a schematic view illustrating how the groups of ejection ports in the liquid ejection head according to another embodiment are arranged.

FIG. 9 shows how the group of ejection ports are arranged in the liquid ejection head according to the present invention. Elements having the same functions as those in the above embodiment are denoted by the same reference numerals, and duplicate description will be omitted. The ejection port plate 21*a* having the ejection port group 19A formed therein and from which larger liquid droplets are ejected has the smaller discharging ports 19*a*' formed at each end of the ejection port group 19A in its arrangement direction and having a diameter of about 10 $\mu$m. In contrast, the ejection port plate 21*b* having the ejection port group 19B formed therein and from which smaller liquid droplets are ejected has the larger discharging ports 19*b*' formed at each end of the ejection port group 19B in its arrangement direction and having a diameter of about 16 $\mu$m. The size and shape of the liquid discharging ports 19*a*' in this embodiment are set substantially the same as those of the ejection ports 19*b* from which smaller liquid droplets are ejected. The size and shape of the liquid discharging ports 19*b*' are also set substantially the same as those of the ejection ports 19*a* from which larger liquid droplets are ejected. With this configuration, the sum of the areas of the ejection ports 19*a* from which larger liquid droplets are ejected and the liquid discharging ports 19*a*' can be made closer to the sum of the areas of the ejection ports 19*b* from which smaller liquid droplets are ejected and the liquid discharging ports 19*b*'. As a result, the amount of liquid discharged from the ejection port group 19A is closer to the amount of liquid discharged from the ejection port group 19B, therefore achieving an efficient suction recovering process.

The number, size, and shape of the liquid discharging ports 19*a*' and 19*b*' are not limited to the above embodiment. Effects obtained more closely meet the objects of the present invention as the sum of the areas of the ejection ports 19*b* from which smaller liquid droplets are ejected and the liquid discharging ports 19*b*' is closer to the sum of the areas of the ejection ports 19*a* from which larger liquid droplets are ejected and the liquid discharging ports 19*a*'. The cross sectional area and length of the passage of the liquid supplying pipes 17*a* that is in communication with the ejection port group 19A from which larger liquid droplets are ejected can be set equal to those of the liquid supplying pipes 17*b* that is in communication with the ejection port group 19B from which smaller liquid droplets are ejected, as in the case with the above embodiment shown in FIG. 7. However, the cross sectional areas or lengths of the passages of the liquid supplying pipes 17*a* and 17*b* can be effectively changed as required.

In the above described embodiments, the number, size, and shape of the liquid discharging ports 19*a* and 19*b* formed in the two ejection port plates 21*a* and 21*b*, respectively, are appropriately set. This makes the amount of liquid sucked and discharge from the ejection port group 19A closer to the amount of liquid sucked and discharge from the ejection port group 19B. However, the objects of the present invention are achieved to some degree by setting, within a predetermined range, the difference between the sum of the opening areas of the ejection ports 19*a* constituting the ejection port group 19A in the ejection port plate 21*a* and the sum of the opening areas of the ejection ports 19*b* constituting the ejection port group 19B.

Figure 10:
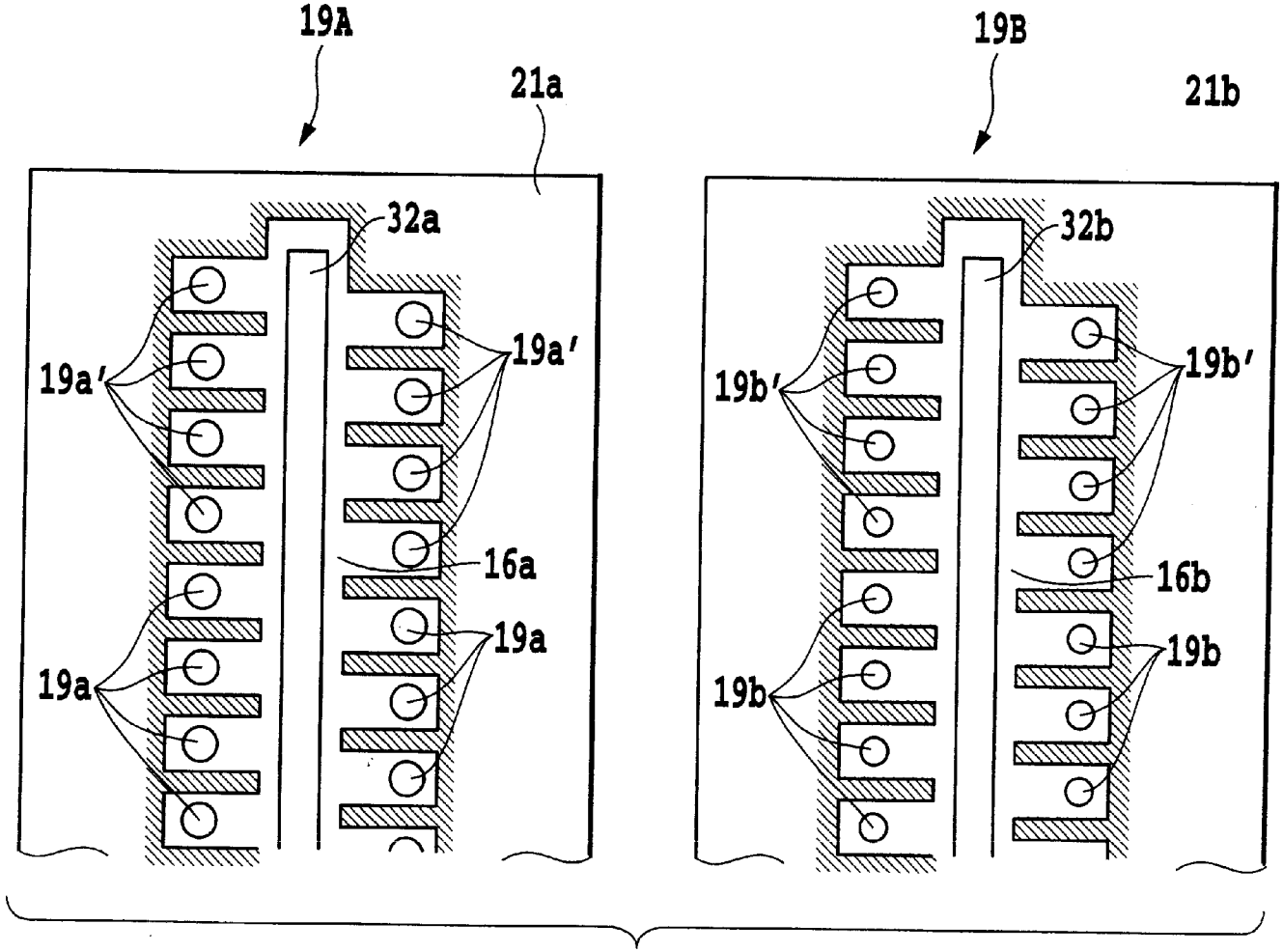
FIG. 10 is a partially extracted sectional view showing still another embodiment of the liquid ejection head according to the present invention.

FIG. 10 shows the sectional structure of a part of the liquid ejection head according to the present invention Elements having the same functions as those in the above embodiment are denoted by the same reference numerals, and duplicate description will be omitted. The ejection port group 19A from which larger liquid droplets are ejected is composed of four liquid discharging ports 19*a*' located at each end of the group 19A in its arrangement direction, and 128 ejection ports 19*a* in each row. Two rows each composed of these liquid discharging ports 19*a*' and ejection ports 19*a* are arranged in parallel and in communication with the communication liquid chamber 16*a*. The common liquid chamber 16*a* has the liquid supplying pipe 17*a* (not shown) connected thereto via an ink supplying port 32*a*. The liquid discharging ports 19*a*' and ejection ports 19*a* of the ejection port group 19A from which larger liquid droplets are ejected have a set diameter of 12 $\mu$m and are arranged at an interval of 300 dpi per row. In this embodiment, the two rows are arranged offset by a half pitch along the arrangement direction, so that the apparent arrangement pitch thereof is 600 dpi. Likewise, the ejection port group 19B from which smaller liquid droplets are ejected is composed of four liquid discharging ports 19*b*' located at each end of the group 19B in its arrangement direction, and a total of 128 ejection ports 19*b*. Two rows each composed of these liquid discharging ports 19*b*' and ejection ports 19*b* are also arranged in parallel and in communication with the communication liquid chamber 16*b*. The common liquid chamber 16*b* has the liquid supplying pipe 17*b* (not shown) connected thereto via an ink supplying port 32*a*. The liquid discharging ports 19*b*' and ejection ports 19*b* of the ejection port group 19B from which smaller liquid droplets are ejected have a set diameter of 10 $\mu$m and are arranged at an interval of 300 dpi per row. In this embodiment, the two rows are arranged offset by a half pitch along the arrangement direction, so that the apparent arrangement pitch thereof is 600 dpi.

Consequently, the sum of the opening areas in the ejection port group 19A from which larger liquid droplets are ejected is reduced to about 1.4 times the sum of the opening areas in the ejection port group 19B from which smaller liquid droplets are ejected. When the former is about 1.6 or less times the latter, the liquid can be allowably uniformly discharged from all the ejection port groups during suction recovery. Thus, in this embodiment, the difference in the amount of liquid sucked between the ejection port groups 19A and 19B can be set within an allowable range.

In the above described embodiment, the liquid supplying passage branches into two portions with respect to the head cartridge 13. However, the present invention is effectively applicable to a liquid ejection head in which the liquid supplying passage branches into three or more portions.

Figure 11:
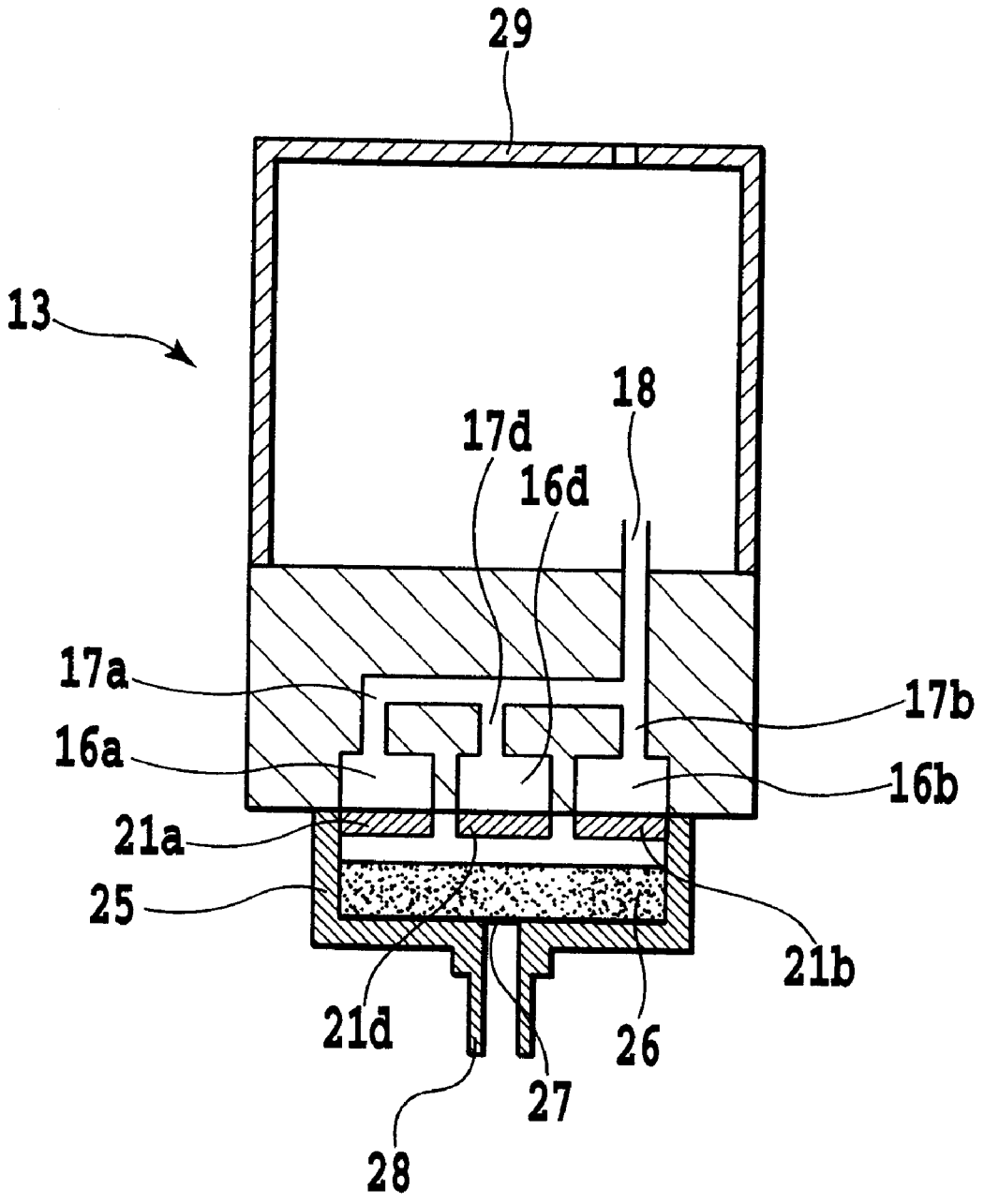
FIG. 11 is a sectional view illustrating another embodiment of the liquid ejection head according to the present invention, together with a capping member therefor.
Figure 12:
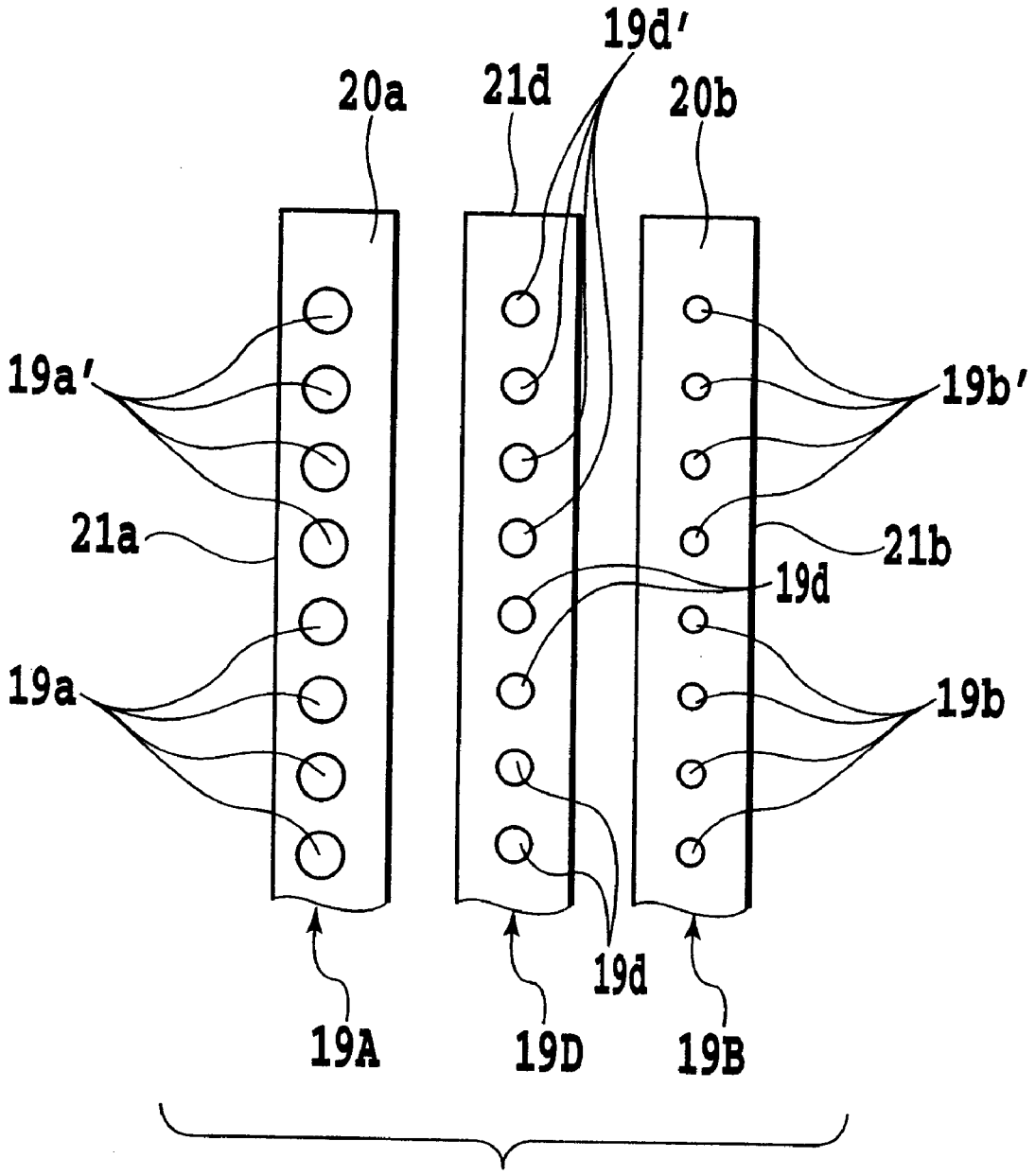
FIG. 12 is a schematic view illustrating how groups of ejection ports in the liquid ejection head according to the embodiment shown in FIG. 10 are arranged.

FIG. 11 shows yet another embodiment of the liquid ejection head according to the present invention, and FIG. 12 shows the front shape of the ejection port surface thereof. Elements having the same functions as those in the above embodiment are denoted by the same reference numerals, and duplicate description will be omitted. The head cartridge 13 in this embodiment comprises the ejection port plate 21*a* having the ejection port group 19A from which larger liquid droplets are ejected, a ejection port plate 21*d* having a ejection port group 19D from which middle-sized liquid droplets are ejected, and the ejection port plate 21*b* having the ejection port group 19B from which smaller liquid droplets are ejected. The head cartridge 13 has the common liquid chambers 16*a* and 16*b* and a common liquid chamber 16*d*, and the liquid supplying pipes 17*a* and 17*b* and a liquid supplying pipe 17*d*. The ejection ports 19*a*, 19*d*, and 19*b* constituting the ejection port groups 19A, 19D, and 19B have diameters of about 16, 10, and 7 $\mu$m, respectively, and each ejection port row is formed of 128 ejection ports arranged at an interval of 600 dpi. As in the case with the above embodiment, the ejection ports located at each end of the ejection port group in its arrangement direction are the liquid discharging ports 19*a*' and 19*b*' and liquid discharging ports 19*d*'. Four, two, and one picoliters of liquid droplets are ejected from the ejection ports 19*a*, 19*d*, and 19*d*, respectively.

In this embodiment, the liquid supplying pipes 17*a*, 17*d*, and 17*b* are set to branch at two positions, and have lengths set at the ratio of 1:2:4. However, no problems occur if the liquid supplying pipes 17*a*, 17*d*, and 17*b* are set to branch at only one position. The liquid supplying pipes 17*a*, 17*d*, and 17*b* may have different cross sectional areas, for example, set at the ratio of 1:2:4.

With this configuration, the larger-droplets ejection ports 19*a*, having a larger sum of ejection port areas and a larger amount of ink discharged during suction recovery, have a relatively larger passage resistance than the other ejection ports. In contrast, the smaller-droplets ejection ports 19*b*, having a smaller sum of ejection port areas and a smaller amount of ink discharged during suction recovery, have a relatively smaller passage resistance than the other ejection ports. As a result, the amount of liquid discharged during suction recovery is similar between the ejection port group 19A from which larger liquid droplets are ejected and the ejection port group 19D from which middle-sized droplets are ejected and the ejection port group 19B from which smaller liquid droplets are ejected, therefore restraining the liquid from being wastefully discharged during suction recovery.

In the above described embodiment, a single type of liquid or ink of a single color is ejected from the head cartridge 13. However, the present invention is applicable to a head cartridge that recovers the suction of different types of liquids or inks of plural colors using the same capping member.

Figure 13:
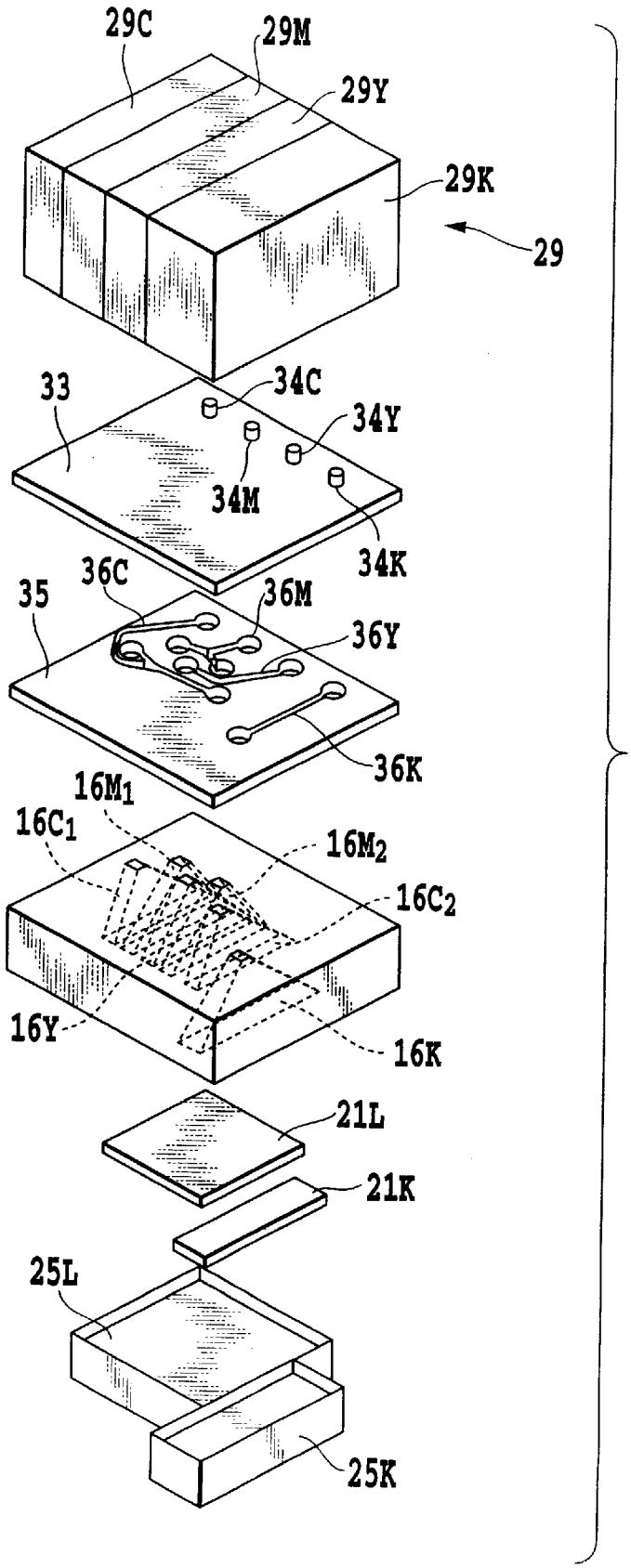
FIG. 13 is an exploded perspective view of still another embodiment of the liquid ejection head according to the present invention.

FIG. 13 shows the structure of the liquid ejection head according to the present invention as disassembled. Elements having the same functions as those in the above embodiment are denoted by the same reference numerals, and duplicate description will be omitted. The liquid tank 29 in this embodiment is composed of four ink tanks, that is a black ink tank 29K that stores black ink, a cyan ink tank 29C that stores cyan ink, a magenta ink tank 29M that stores magenta ink, and a yellow ink tank 29Y that stores yellow ink. The color inks from the liquid tank 29 pass through connected portions 34K, 34C, 34M, and 34Y formed in a connection plate 33 and slit-shaped ink supplying passages 36K, 36C, 36M, and 36Y formed in a passage forming plate 35, and are supplied to individual common liquid chambers 16K, 16$C_1$, 16$C_2$, 16$M_1$, 16$M_2$, and 16Y. In this embodiment, the cyan ink supplying passage 36C and the magenta ink supplying passage 36M each branch into two portions to constitute liquid supplying pipes. The ink supplying passages 36C and 36M are connected to the cyan ink common liquid chambers 16$C_1$ and 16$C_2$ and the magenta ink common liquid chambers 16$M_1$ and 16$M_2$, respectively. Thus, the head comprises a total of five common liquid chambers 16K, 16$C_1$, 16$C_2$, 16$M_1$, 16$M_2$, and 16Y. The common liquid chambers 16K, 16$C_1$, 16$C_2$, 16$M_1$, 16$M_2$, and 16Y are equipped with a color ink ejection port plate 21L corresponding to the color inks other than the black one and a black ink ejection port plate 21K. Droplets can be ejected from the ejection ports formed in the ejection port plates 21L and 21K.

During suction recovery, suction pumps (not shown) operate independently which are in communication with a color ink capping member 25L and a black ink capping member 25K, respectively. This enables the color inks and the black ink to be separately sucked and discharged.

Figure 14:
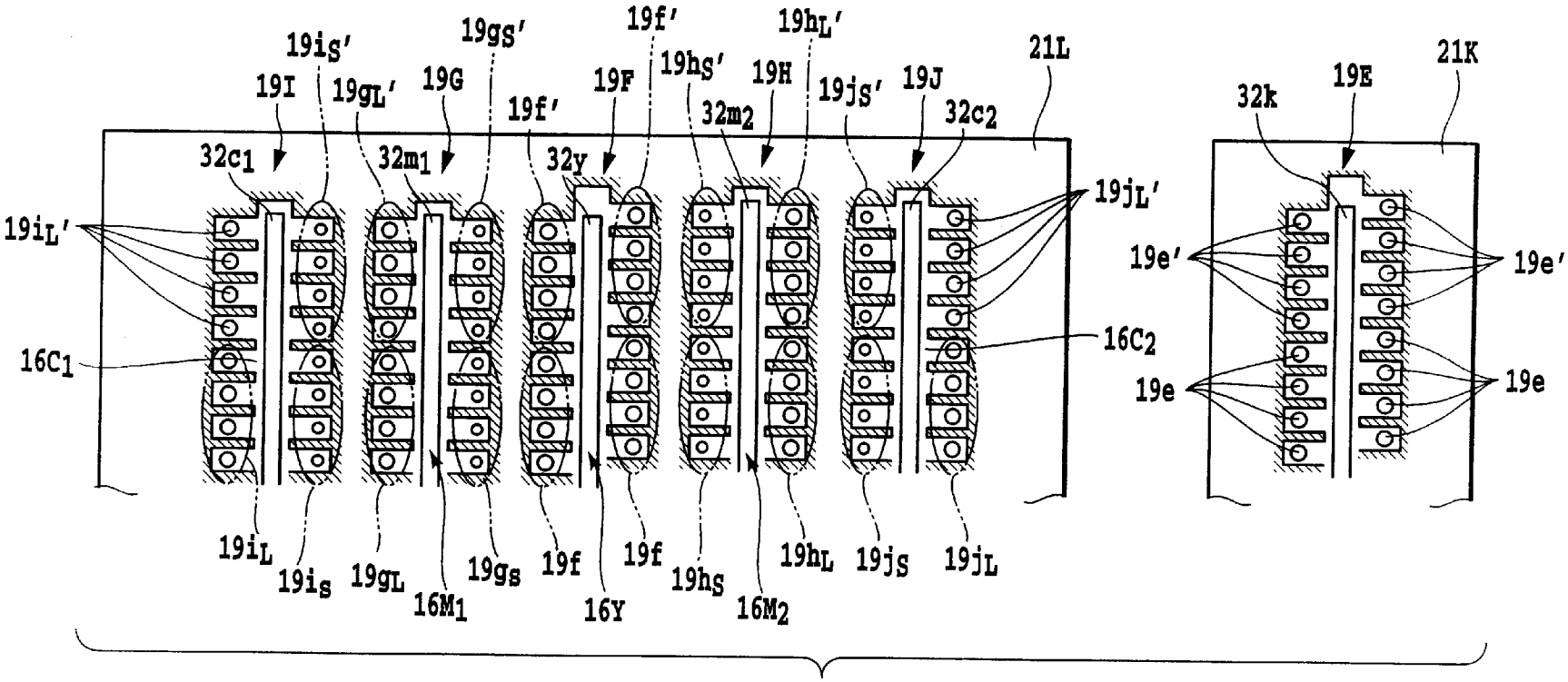
FIG. 14 is a partially extracted sectional view of the embodiment shown in FIG. 13.

FIG. 14 shows the sectional structure of a part of the liquid ejection head according to this embodiment. This liquid ejection head has rows of cyan ink ejection ports disposed at the respective ends thereof in the scanning direction, rows of magenta ink ejection ports disposed inside the respective cyan ink ejection port rows, and a row of yellow ink ejection ports disposed in the middle of the head so that when a bidirectional printing operation is performed, that is, a printing operation is performed during both forward and backward scanning, the same color ink ejection order is maintained during both the forward and backward scanning operations of the liquid ejection head. A ejection port group 19E formed in the black ink ejection port plate 21K is composed of four liquid discharging ports 19*e*' located at each end of the group in its arrangement direction, and 160 ejection ports 19*e* in each row. Two rows each composed of these liquid discharging ports and ejection ports are also arranged in parallel and in communication with the communication liquid chamber 16K. These liquid discharging ports 19*e* and ejection ports 19*e* are arranged at an interval of 300 dpi per row. However, the two rows are arranged offset by a half pitch along the arrangement direction, so that the apparent arrangement pitch thereof is 600 dpi.

The color ink ejection port plate 21L has a yellow ink ejection port group 19F formed in the center thereof. Magenta ink ejection port groups 19G and 19H are formed in the color ink ejection port plate 21L so as to sandwich the yellow ink ejection port group 19F therebetween. Cyan ink ejection port groups 19I and 19J are formed at the respective ends of the color ink ejection port plate 21L so as to sandwich the above three ejection port groups 19F to 19H therebetween.

As in the case with the black ink ejection port group 19E, the yellow ink ejection port group 19F is composed of four liquid discharging ports 19*f*' located at each end of the group in its arrangement direction, and 128 ejection ports 19*f* in each row. Two rows each composed of these liquid discharging ports and ejection ports are also arranged in parallel and in communication with the communication liquid chamber 16Y. The liquid discharging ports 19*f*' and ejection ports 19*f* all have a set diameter of 16 μm and are arranged at an interval of 600 dpi per row. In this embodiment, the two rows are arranged offset by a half pitch along the arrangement direction, so that the apparent arrangement pitch thereof is 1200 dpi.

The magenta ink ejection port groups 19G and 19H and the cyan ink ejection port groups 19I and 19J each have two rows formed thereon. One of the rows is composed of 128 ejection ports 19$g_L$, 19$h_L$, 19$i_L$, or 19$j_L$ from which larger liquid droplets are ejected and which have a diameter of 16 μm and four liquid discharging ports 19$g_L$', 19$h_L$', 19$i_L$', and 19$j_L$' arranged at each end of the group in its arrangement direction, the ejection ports and liquid discharging ports being arranged at 600 dpi. The other row is composed of 128 ejection ports 19$g_S$, 19$h_S$, 19$i_S$, or 19$j_S$ from which smaller liquid droplets are ejected and which have a diameter of 10 μm and four liquid discharging ports 19$g_S$', 19$h_S$', 19$i_S$', and 19$j_S$' arranged at each end of the group in its arrangement direction, the ejection ports and liquid discharging ports being arranged at 600 dpi. In this embodiment, the magenta ink ejection port group 19G and cyan ink ejection port group 19I, located at one side of the yellow ink ejection port group 19F, are arranged offset by a half pitch from the magenta ink ejection port group 19H and cyan ink ejection port groups 19J, located at the other side of the yellow ink ejection port group 19F. Thus, the magenta ink ejection port groups 19G and 19H and the cyan ink ejection port groups 19I and 19J also have an apparent arrangement pitch of 1200 dpi. Since the ejection ports for the yellow ink, which provides more unnoticeable dot granularity than the cyan and magenta inks, include no smaller-droplet ejection ports, all the yellow ink ejection ports can be accommodated in a single common liquid chamber, therefore reducing the production costs of the print head. Furthermore, the distance traveled during canning can be reduced to enable the size of the apparatus to be reduced.

With this configuration, for the yellow ink ejection port group 19F, which has the largest sum of opening areas, the sum is reduced to about 1.4 times the sum of the opening areas in each of the magenta and cyan ink ejection port groups 19G to 19J. when the former sum is about 1.6 or less times the latter sum, the liquid can be allowably uniformly discharged from all the ejection port groups during suction recovery. Thus, in this embodiment, the difference in the amount of liquid sucked can be set within an allowable range.

The numbers, sizes, and shapes of the ejection ports and liquid discharging ports are not limited to the above embodiment. Effects obtained more closely meet the objects of the present invention as the sum of the areas in the ejection port group having the largest sum of opening areas is closer to the sum of the areas in the ejection port group having the smallest sum of opening areas. To achieve this, the cross sectional areas or lengths of the liquid supplying passage 36K, 36C, 36M, and 36Y can be effectively changed as required.

Figure 15:
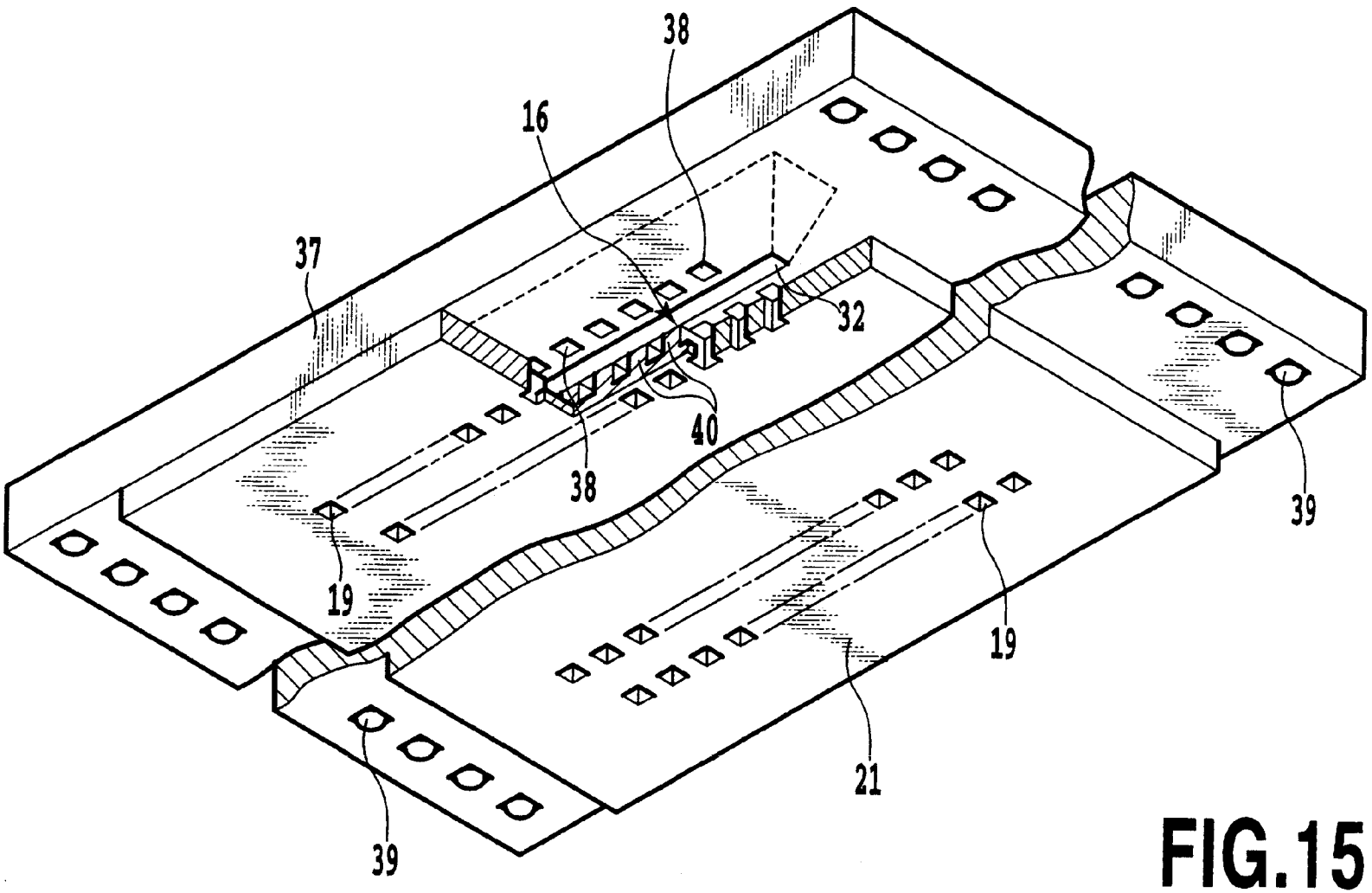
FIG. 15 is a perspective view illustrating the appearance of an essential part of the liquid ejection head according to the embodiment shown in FIG. 13, which is shown broken.

FIG. 15 shows the structure of an essential part of the above described color liquid ejection head as broken. The essential part of the liquid ejection head of this embodiment has ejection energy generating portions, a common liquid chamber 16, ejection ports 19, and others formed on a silicon substrate 37 of 0.5 to 1.0 mm thickness. The silicon substrate 37 has a slot-shaped ink supplying port 32 formed by anisotropic etching using the crystal orientation of the silicon and connected to the ink supplying passage 36. The ink supplying port 32 has two rows of a plurality of (in this embodiment, 128) electrothermal transducers 38 formed at the respective sides thereof and offset by a half pitch and in which the transducers 38 are arranged at predetermined intervals in the longitudinal direction of the ink supplying port. These electrothermal transducers 38 constitute the ejection energy generating portions according to the present invention. In addition to these electrothermal transducers 38, the silicon substrate 37 has bump-shaped connection terminals 39 formed thereon and which is made of gold or the like and which allows the electrothermal transducers 38 to be electrically connected to an electrically circuit board (not shown) and also has electric wiring (not shown) formed thereon and which is made of aluminum or the like, both the connection terminals and electric wiring being formed using a thin film forming technique. Driving ICs (not shown) provides driving signals to the electrothermal transducers 38 via the connection terminals 39, while driving power is supplied to the electrothermal transducers 38.

The silicon substrate 37 has a ejection port plate 21 provided thereon and having the plurality of ejection ports 19 located opposite the electrothermal transducers 38 via the common liquid chamber 16 that is in communication with the ink supplying port 32. Liquid channels are formed between the ejection port plate 21 and the silicon substrate 37 so as to be in communication with the individual ejection ports 19 and the common liquid chamber 16. Partitioning walls 40 are each formed between the adjacent liquid channels. The common liquid chamber 16, liquid channels, and partitioning walls 40 are formed together with the ejection port plate 21 using a photolithography technique as in the case with the ejection ports 19.

In the above embodiment, the sum of the opening areas in the ejection port group having the largest sum of the opening areas is close to the sum of the opening areas in the ejection port group having the smallest sum of the opening areas. However, when the sum of the opening areas in a liquid ejection head having the largest sum of opening areas in one or more ejection port groups that are in communication with an identical liquid tank is 5 or less times the sum of the opening areas in a liquid ejection head having the smallest sum of opening areas in one or more ejection port groups that are in communication with another identical liquid tank, or is close or equal to the smallest sum, then this prevents an excessive increase only in the amount of liquid discharged from the liquid tank that is in communication with the liquid ejection head having the largest sum of opening areas in the ejection port group. This prevents bubbles from being contained in the liquid channels and liquid supplying passages. This effect is particularly significant in liquid ejection heads using a liquid tank 29 having a porous member such as sponge accommodated inside the tank and which holds the liquid.

The present invention achieves distinct effect when applied to the liquid ejection head, the head cartridge, or the image forming apparatus which has means for generating thermal energy such as electrothermal transducers or laser beam, and which causes changes in ink by the thermal energy so as to eject liquid. This is because such a system can achieve a high density and high resolution printing.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet printing systems, it is particularly suitable for the on-demand type apparatus. This is because the on-demand type apparatus has electrothermal transducers, each disposed on a sheet or liquid passage that retains liquid, and operates as follows: first, one or more driving signals are applied to the electrothermal transducers to cause thermal energy corresponding to printing information; second, the thermal energy induces sudden temperature rise that exceeds the nucleate boiling so as to cause the film boiling on heating portions of the liquid ejection head; and third, bubbles are grown in the liquid corresponding to the driving signals. By using the growth and collapse of the bubbles, the ink is expelled from at least one of the ejecting ports of the head to form one or more liquid drops. The driving signal in the form of a pulse is preferable because the growth and collapse of the bubbles can be achieved instantaneously and suitably by this form of driving signal. As the driving signal in the form of a pulse, those described in U.S. Pat. Nos. 4,463,359 and 4,345,262 are preferable.

It is preferable that the rate of temperature rise of the heating portions described in U.S. Pat. No. 4,313,124 be adopted to achieve better printing.

U.S. Pat. Nos. 4,558,333 and 4,459,600 disclose the following structure of a liquid ejection head, which is incorporated to the present invention: this structure includes heating portions disposed on bent portions in addition to a combination of the ejecting ports, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejecting ports of the electrothermal transducers, and the latter discloses a structure in which openings for absorbing pressure waves caused by thermal energy are formed corresponding to the ejecting ports. Thus, irrespective of the type of the liquid ejection head, the present invention can achieve printing positively and effectively.

The present invention can be applied to various serial type liquid ejection heads: a liquid ejection head fixed to the main assembly of a image forming apparatus; a conveniently replaceable chip type liquid ejection head which, when loaded on the main assembly of a image forming apparatus, is electrically connected to the main assembly, and is supplied with liquid therefrom; and a cartridge type liquid ejection head integrally including a liquid reservoir.

It is further preferable to add a recovery system for ejecting liquid from the ejection head in adequate condition, or a preliminary auxiliary system for a liquid ejection head as a constituent of the image forming apparatus because they serve to make the effect of the present invention more reliable. Examples of the recovery system are a capping means and a cleaning means for the liquid ejection head, and a pressure or suction means for the liquid ejection head. Examples of the preliminary auxiliary system are a preliminary heating means utilizing electrothermal transducers or a combination of other heater elements and the electrothermal transducers, and a means for carrying out preliminary ejection of liquid independently of the ejection for printing. These systems are effective for reliable printing.

The number and type of liquid ejection heads to be attached on a image forming apparatus can be also detached. For example, only one liquid ejection head corresponding to a single color ink, or a plurality of liquid ejection heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing. In this case, the treatment liquid (the printablity enhanced liquid) for adjusting the printability of the ink may also be ejected from each individual heads or a common ejection head to the printing medium in accordance with a kind of the printing medium or the printing mode.

Furthermore, although the above-described embodiments use liguids, liquids that are liquid when the printing signal is applied can be used: for example, liquids can be employed that solidify at a temperature lower than the room temperature and are softened or liquefied in the room temperature. This is because in the ink jet system, the liquid is generally temperature adjusted in a range of 30° C. to 70° C. so that the viscosity of the liquid is maintained at such a value that the liquid can be ejected reliably. In addition, the present invention can be applied to such apparatus where the liquid is liquefied just before the ejection by the thermal energy as follows so that the liquid is expelled from the ports in the liquid state, and then begins to solidify on hitting the printing medium, thereby preventing the liquid evaporation: the liquid is transformed from solid to liquid state by positively utilizing the thermal energy which would otherwise cause the temperature rise; or the liquid, which is dry when left in air, is liquefied in response to the thermal energy of the printing signal. In such cases, the liquid may be retained in recesses or through holes formed in a porous sheet as liquid or solid substances so that the liquid faces the electrothermal transducers as described in Japanese Patent Application Laying-open Nos. 54-56847 (1979) or 60-71260 (1985). The present invention is most effective when it uses the film boiling phenomenon to expel the liquid.

Furthermore, the image forming apparatus in according to the present invention can be employed not only as an image output terminal of an information processing device such as a computer, but also as an output device of a copying machine combining with a reader or the like, a facsimile apparatus having a transmission and receiving function, or printing press for cloth. A sheet or web paper, a wooden or plastic board, a stone slab, a plate glass, metal sheet, a three dimensional structure or the like may be used as the printing medium in according to the present invention.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A liquid ejection head comprising:

a liquid supplying passage having one end in communication with a liquid supplying port to which a liquid is supplied, said liquid supplying passage branching into a plurality of branching paths;

a plurality of common liquid chambers which are in communication with respective ones of the plurality of branching paths; and a plurality of opening groups which are in communication with said respective common liquid chambers via liquid channels and which are opened to atmosphere;

wherein a cross sectional area of the branching path which is in communication with one of said plurality of opening groups which has a larger sum of opening areas is smaller than a cross sectional area of the branching path which is in communication with one of said plurality of opening groups which has a smaller sum of opening areas.

2. A liquid ejection head comprising:

a liquid supplying passage having one end in communication with a liquid supplying port to which a liquid is supplied, said liquid supplying passage branching into a plurality of branching paths;

a plurality of common liquid chambers which are in communication with respective ones of the plurality of branching paths; and a plurality of opening groups which are in communication with said respective common liquid chambers via liquid channels and which are opened to atmosphere;

wherein a length of the branching path which is in communication with one of said plurality of opening groups which has a larger sum of opening areas is longer than a length of the branching path which is in communication with one of said plurality of opening groups which has a smaller sum of opening areas.

3. A liquid ejection head comprising:

a liquid supplying passage having one end in communication with a liquid supplying port to which a liquid is supplied, said liquid supplying passage branching into a plurality of branching paths;

a plurality of common liquid chambers which are in communication with respective ones of the plurality of branching paths; and a plurality of opening groups which are in communication with said respective common liquid chambers via liquid channels and which are opened to atmosphere;

wherein a branching portion of the branching path which is in communication with one of said plurality of opening groups which has a larger sum of opening areas is more downstream in a liquid flowing direction than a branching portion of the branching path which is in communication with one of said plurality of opening groups which has a smaller sum of opening areas.

4. The liquid ejection head as claimed in claim 3, wherein three or more opening groups are provided.

5. A liquid ejection head comprising:

a liquid supplying passage having one end in communication with a liquid supplying port to which a liquid is supplied, said liquid supplying passage branching into a plurality of branching paths;

a plurality of common liquid chambers which are in communication with respective ones of the plurality of branching paths; and a plurality of opening groups which are in communication with said respective common liquid chambers via liquid channels and which are opened to atmosphere;

wherein said plurality of opening groups include;

an opening group that is composed of a plurality of ejection ports arranged at predetermined intervals to eject the liquid to a printing medium, and liquid discharging ports disposed adjacent to the ejection ports which are located at each end of the plurality of the ejection ports in an arrangement direction thereof, the liquid discharging ports not relating to formation of images on the printing medium; and an opening group which is composed only of the ejection ports.

6. A liquid ejection head comprising a plurality of opening groups which are in communication with respective ones of a plurality of common liquid chambers via liquid channels and which are opened to atmosphere, said plurality of opening groups each having a plurality of ejection ports arranged at predetermined intervals to eject the liquid to a printing medium, and liquid discharging ports disposed adjacent to the ejection ports which are located at each end of the plurality of the ejection ports in an arrangement direction thereof, the liquid discharging ports not relating to formation of images on the printing medium, wherein the number of the liquid discharging ports of one of said plurality of opening groups which has a larger sum of opening areas of the ejection ports are fewer than the number of the liquid discharging ports in one of said plurality of opening groups which has a smaller sum of opening areas of the ejection ports.

7. A liquid ejection head comprising a plurality of opening groups which are in communication with respective ones of a plurality of common liquid chambers via liquid channels and which are opened to atmosphere, said plurality of opening groups each having a plurality of ejection ports arranged at predetermined intervals to eject the liquid to a printing medium and liquid discharging ports disposed adjacent to the ejection ports which are located at each end of the plurality of the ejection ports in an arrangement direction thereof, the liquid discharging ports not relating to formation of images on the printing medium, wherein a sum of opening areas of the liquid discharging ports in one of said plurality of opening groups which has a larger sum of opening areas of the ejection ports is smaller than a sum of opening areas of the liquid discharging ports in one of said plurality of opening groups which has a smaller sum of opening areas of the ejection ports.

8. The liquid ejection head as claimed in claim 6 or 7, wherein the plurality of common liquid chambers are in communication with the respective ones of a plurality of branching paths of a liquid supplying passage having one end in communication with the liquid supplying port to which the liquid is supplied, the liquid supplying passage branching into a plurality of branching paths.

9. The liquid ejection head as claimed in any one of claims 1 to 3 and 5 to 7, wherein at least one of said plurality of opening groups has a different number of openings from those of the other opening groups.

10. The liquid ejection head as claimed in any one of claims 1 to 3 and 5 to 7, wherein at least one of said plurality of opening groups has at least one opening, the area of which is different from those of the openings of the other opening groups.

11. A liquid ejection head comprising a plurality of head portions each having a liquid supplying passage having one end in communication with a liquid supplying port to which a liquid is supplied, the liquid supplying passage branching into a plurality of branching paths, a plurality of common liquid chambers which are in communication with respective ones of the plurality of branching paths, and a plurality of opening groups which are in communication with the respective common liquid chambers via liquid channels and which are opened to atmosphere, at least one of all the opening groups having a different number of openings from those of the other opening groups, wherein a sum of the opening areas in one of all the opening groups which has the largest sum is 1.6 or less times a sum of the opening areas in the other opening group which has the smallest sum, and wherein a sum of the areas of the openings constituting the plurality of opening groups in one of said plurality of head portions which has the largest sum is 5 or less times a sum of the areas of the openings constituting the plurality of opening groups in the other head portion which has the smallest sum.

12. A liquid ejection head comprising:

a first head portion having a liquid supplying passage having one end in communication with a liquid supplying port to which a liquid is supplied, the liquid supplying passage branching into a plurality of branching paths, a plurality of common liquid chambers that are in communication with respective ones of the plurality of branching paths, and a plurality of opening groups which are in communication with the respective common liquid chambers via liquid channels and which are opened to atmosphere; and a second head portion having common liquid chambers that are in communication with a liquid supplying port to which a liquid is supplied, and opening groups which are in communication with the respective common liquid chambers via liquid channels and which are opened to the atmosphere;

at least one of all the opening groups having a different number of openings from those of the other opening groups;

wherein a sum of the opening areas in one of all the opening groups which has the largest sum is 1.6 or less times a sum of the opening areas in the other opening group which has the smallest sum, and wherein a sum of the areas of the openings constituting said plurality of opening groups in one of said first and second head portions which has the largest sum is 5 or less times a sum of the areas of the openings constituting said plurality of opening groups in the other head portion which has the smallest sum.

13. A liquid ejection head comprising a plurality of head portions each having a liquid supplying passage having one end in communication with a liquid supplying port to which a liquid is supplied, the liquid supplying passage branching into a plurality of branching paths, a plurality of common liquid chambers which are in communication with respective ones of the plurality of branching paths, and a plurality of opening groups which are in communication with the respective common liquid chambers via liquid channels and which are opened to atmosphere, at least one of all the opening groups having at least one opening, the area of which is different from those of the openings of the other opening groups;

wherein a sum of the opening areas in one of all the opening groups which has the largest sum is 1.6 or less times a sum of the opening areas in one of all the opening groups which has the smallest sum, and wherein a sum of the areas of the openings constituting the plurality of opening groups in one of said plurality of head portions which has the largest sum is 5 or less times a sum of the areas of the openings constituting the plurality of opening groups in the other head portion which has the smallest sum.

14. A liquid ejection head comprising:

a first head portion having a liquid supplying passage having one end in communication with a liquid supplying port to which a liquid is supplied, the liquid supplying passage branching into a plurality of branching paths, a plurality of common liquid chambers that are in communication with respective ones of the plurality of branching paths, and a plurality of opening groups which are in communication with the respective common liquid chambers via liquid channels and which are opened to atmosphere; and a second head portion having common liquid chambers which are in communication with a liquid supplying port to which a liquid is supplied, and opening groups which are in communication with the respective common liquid chambers via liquid channels and which are opened to the atmosphere;

at least one of all the opening groups having at least one opening, an area of which is different from those of the openings of the other opening groups;

wherein a sum of the opening areas in one of all the opening groups which has the largest sum is 1.6 or less times a sum of the opening areas in the other opening group which has the smallest sum, and wherein a sum of the areas of the openings constituting said plurality of opening groups in one of said first and second head portions which has the largest sum is 5 or less times a sum of the areas of the openings constituting said plurality of opening groups in the other head portion which has the smallest sum.

15. The liquid ejection head as claimed in claim 13 or 14, wherein at least one of all the opening groups has a different number of openings from those of the other opening groups.

16. The liquid ejection head as claimed in any one of claims 11 to 14, wherein the sum of the opening areas in the opening group having the largest sum is substantially equal to the sum of the opening areas in the opening group having the smallest sum.

17. The liquid ejection head as claimed in any one of claims 1 to 3 and 11 to 14, wherein said opening group has a plurality of ejection ports arranged at predetermined intervals to eject the liquid to a printing medium, and liquid discharging ports disposed adjacent to those of the ejection ports which are located at each end of the plurality of ejection ports in an arrangement direction thereof, the liquid discharging ports not relating to formation of images on the printing medium.

18. The liquid ejection head as claimed in any one of claims 1 to 3, 5 to 7 and 11 to 14, wherein said opening groups are covered by a common capping member before a sucking operation is performed.

19. The liquid ejection head as claimed in any one of claims 1 to 3, 5 to 7 and 11 to 14, wherein a liquid tank which stores the liquid can be connected to the liquid supplying port and has a porous member for containing the liquid.

20. The liquid ejection head as claimed in any one of claims 1 to 3, 5 to 7 and 11 to 14, wherein further comprises ejection energy generating portions provided in the liquid channels to eject a liquid droplet from the openings.

21. The liquid ejection head as claimed in claim 20, wherein said ejection energy generating portions each have an electrothermal transducer that generates thermal energy required to cause film boiling in the liquid.

22. A suction recovering method of simultaneously sucking a liquid through all opening groups of a liquid ejection head as claimed in any one of claims 1 to 3, 5 to 7 and 11 to 14 to allow liquid droplets to be appropriately ejected from the opening groups, the amounts of liquid sucked through the opening groups are substantially equal.

23. A head cartridge comprising:

a liquid ejection head as claimed in any one of claims 1 to 3, 5 to 7 and 11 to 14; and a liquid tank storing a liquid supplied to said liquid ejection head via a liquid supplying port provided to said liquid ejection head.

24. The head cartridge as claimed in claim 23, wherein said liquid tank is detachably attached to said liquid ejection head.

25. An image forming apparatus for forming an image on a print medium by using a liquid ejected from a plurality of ejection port groups of a liquid ejection head of a head cartridge as claimed in claim 23, said apparatus comprising:

a mounting portion for mounting the liquid ejection head or the head cartridge;

means for feeding the printing medium;

a capping member that can cover a ejection port surface in which the plurality of ejection port groups of the liquid ejection head are opened; and suction recovering means for sucking a liquid present in the liquid ejection head, through the plurality of ejection port groups via said capping member.

26. The image forming apparatus as claimed in claim 25, wherein said mounting portion has a carriage for scanning in a direction crossing a direction in which the printing medium are fed.

27. The image forming apparatus as claimed in claim 26, wherein the liquid ejection head is mounted so as to be detachably attached to the carriage via detaching means.

28. The image forming apparatus as claimed in claim 25, wherein the liquid is ink and/or a treatment liquid that adjusts printability of the ink on the printing medium.

29. An image forming apparatus for forming an image on a print medium by using a liquid ejected from a plurality of ejection port groups of a liquid ejection head as claimed in any one of claims 1 to 3, 5 to 7 and 11 to 14, said apparatus comprising:

a mounting portion for mounting the liquid ejection head or the head cartridge;

means for feeding the printing medium;

a capping member that can cover a ejection port surface in which the plurality of ejection port groups of the liquid ejection head are opened; and suction recovering means for sucking a liquid present in the liquid ejection head, through the plurality of ejection port groups via said capping member.

30. The image forming apparatus as claimed in claim 29, wherein said mounting portion has a carriage for scanning in a direction crossing a direction in which the printing medium are fed.

31. The image forming apparatus as claimed in claim 30, wherein the liquid ejection head is mounted so as to be detachably attached to the carriage via detaching means.

32. The image forming apparatus as claimed in claim 29, wherein the liquid is ink and/or a treatment liquid that adjusts printability of the ink on the printing medium.

* * * * *

UNITED STATES PATENT AND TRADEMARK OFFICE

CERTIFICATE OF CORRECTION

PATENT NO. : 6,637,874 B2
DATED : October 28, 2003
INVENTOR(S) : Takeshi Yazawa et al.

It is certified that error appears in the above-identified patent and that said Letters Patent is hereby corrected as shown below:

Column 1,
Line 49, “may” should read -- may be --.

Column 2,
Line 38, “through a” should read -- through an --;
Line 39, “from a” should read -- from an --; and
Line 54, “as” should read -- as a --.

Column 3,
Lines 7 and 14, “bubble” should read -- bubbles --.

Column 9,
Line 22, “cover a” should read -- cover an --.

Column 10,
Line 47, “of a” should read -- of an --.

Column 15,
Lines 15 and 16, “discharge” should read -- discharged --; and
Line 25, “invention” should read -- invention. --.

Column 16
Line 18, “a ejection” should read -- an ejection --; and
Line 18, “having a” should read -- having an --.

Column 17,
Line 43, “A ejection” should read -- An ejection --.

Column 18,
Line 45, “when” should read -- When --.

Column 19,
Line 14, “electrically circuit” should read -- electrical circuit --; and
Line 22, “a ejection” should read -- an ejection --

Column 20,
Lines 43, 45 and 65, “a image” should read -- an image --.

UNITED STATES PATENT AND TRADEMARK OFFICE

CERTIFICATE OF CORRECTION

PATENT NO. : 6,637,874 B2
DATED : October 28, 2003
INVENTOR(S) : Takeshi Yazawa et al.

It is certified that error appears in the above-identified patent and that said Letters Patent is hereby corrected as shown below:

Column 21,
Line 11, “heads” should read -- head --; and
Line 15, “use liguids,” should read -- use liquids, --.

Column 26,
Line 21, “cover a” should read -- cover an --; and
Line 46, “cover a” should read -- cover an --.

Signed and Sealed this

Fifteenth Day of June, 2004

JON W. DUDAS
*Acting Director of the United States Patent and Trademark Office*